United States Patent [19]

Badillo

[11] Patent Number: 4,493,278

[45] Date of Patent: Jan. 15, 1985

[54] ROTARY LOOP TAKER FOR LOCK-STITCH SEWING MACHINE

[75] Inventor: Paul Badillo, Lakewood, Colo.

[73] Assignee: Bakron Corp., Chicago, Ill.

[21] Appl. No.: 499,460

[22] Filed: May 31, 1983

Related U.S. Application Data

[63] Continuation-in-part of Ser. No. 355,228, Mar. 5, 1982, abandoned, which is a continuation-in-part of Ser. No. 292,036, Aug. 11, 1981, abandoned.

[51] Int. Cl.[3] ..... D05B 57/08

[52] U.S. Cl. ..... 112/184; 112/230

[58] Field of Search ..... 112/181, 182, 183, 184, 112/228, 229, 230, 231, 36 (U.S. only)

[56] References Cited

U.S. PATENT DOCUMENTS

| | | | |
|---|---|---|---|
| 1,008,538 | 11/1911 | Gray | 112/228 |
| 1,431,380 | 10/1922 | Dickson | 112/228 |
| 1,928,590 | 9/1933 | Grieb | 112/228 |
| 2,015,472 | 9/1935 | Goosman | 112/228 |
| 2,435,358 | 2/1948 | Kessler | 112/228 |
| 3,139,050 | 6/1964 | Grabowski | 112/228 X |

FOREIGN PATENT DOCUMENTS

| | | | |
|---|---|---|---|
| 62209 | 5/1892 | Fed. Rep. of Germany | 112/228 |
| 933601 | 9/1955 | Fed. Rep. of Germany | 112/228 |
| 1099323 | 2/1961 | Fed. Rep. of Germany | 112/231 |
| 524994 | 4/1955 | Italy | 112/228 |
| 53-47947 | 4/1978 | Japan . | |
| 1042446 | 9/1966 | United Kingdom | 112/181 |

*Primary Examiner*—W. C. Reynolds

*Attorney, Agent, or Firm*—Clement and Ryan

[57] ABSTRACT

A rotary loop taker, for use in a lock-stitch sewing machine, which has a detachable and replaceable hook or loop seizing point. A lug extending downwardly from the main body of the replaceable loop seizing point abuts one end wall of a cut-away portion of the annular frame of the rotary loop taker, and carries a foot that extends inwardly from the annular frame toward the rotatable shaft of the device. The inwardly extending lug foot desirably nests in a notch in the crosswise support member on which the annular frame of the rotary loop taker rests, preferably forming a snug fit with the upper surface of the crosswise support member. The preferable form and dimensions of the loop seizing point and the foot extending inwardly from the downwardly extending lug are disclosed. Ledges formed in the inner wall of the replaceable loop seizing point define the initial portion of the raceway for the bobbin case with which the rotary loop taker is used. The loop seizing point is reliably secured to its circular frame in one embodiment by means of screws and stud means providing accurate alignment of the loop seizing point with the frame. In another embodiment, it is secured by releasable means that not only permits separation of the loop seizing point from the annular frame without any movement in the radial direction with respect to the frame, but is also located in an exposed position readily accessible to the operator of the machine.

20 Claims, 27 Drawing Figures

FIG. 1
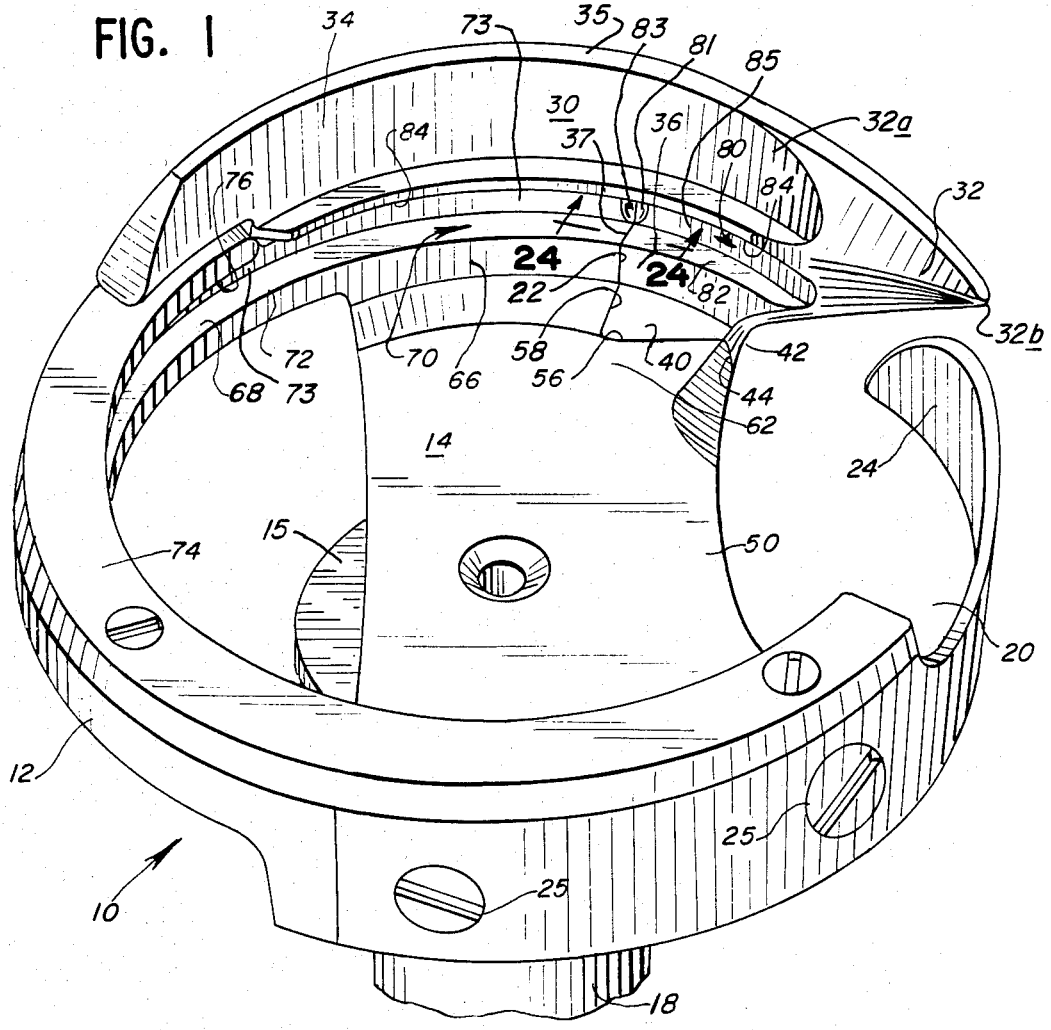
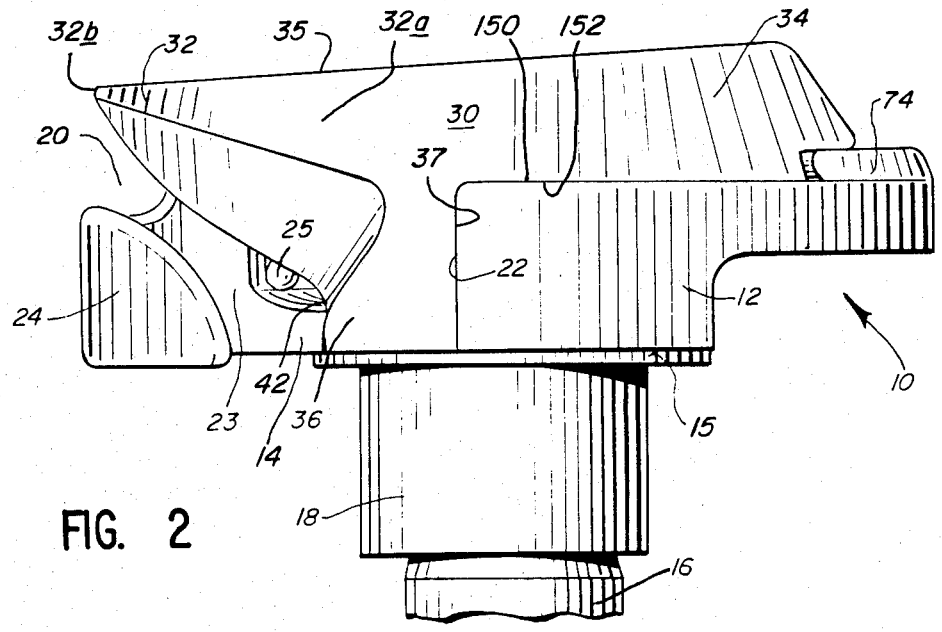
FIG. 2

FIG. 3
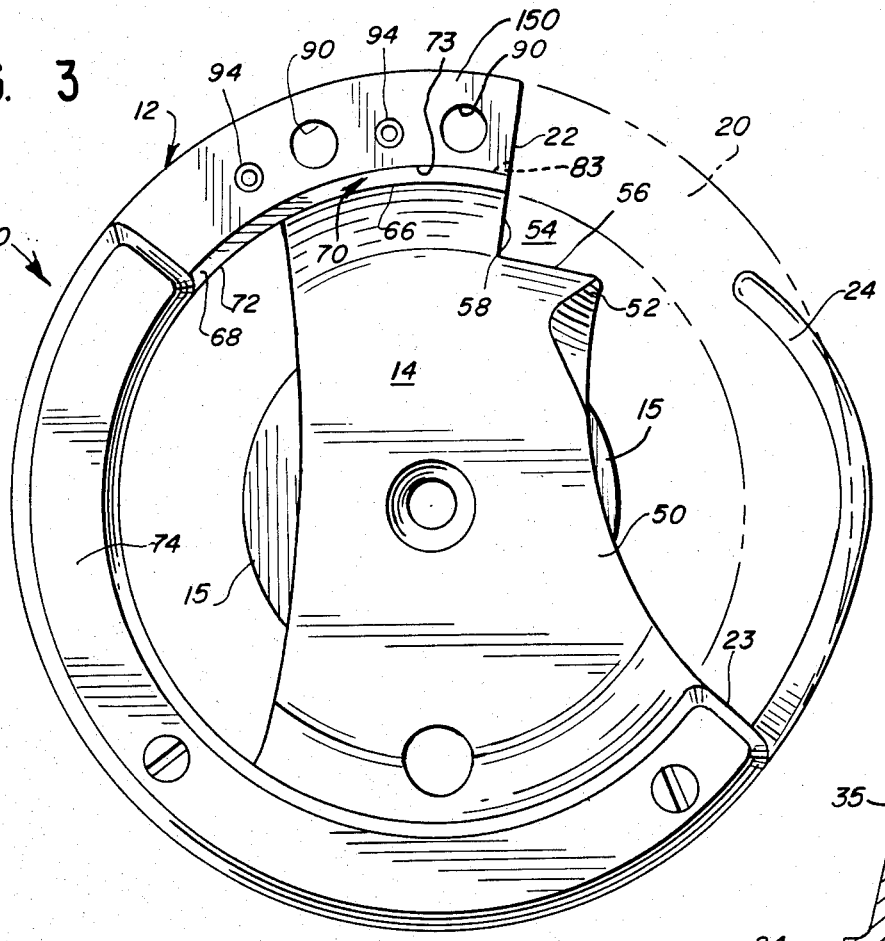
FIG. 4
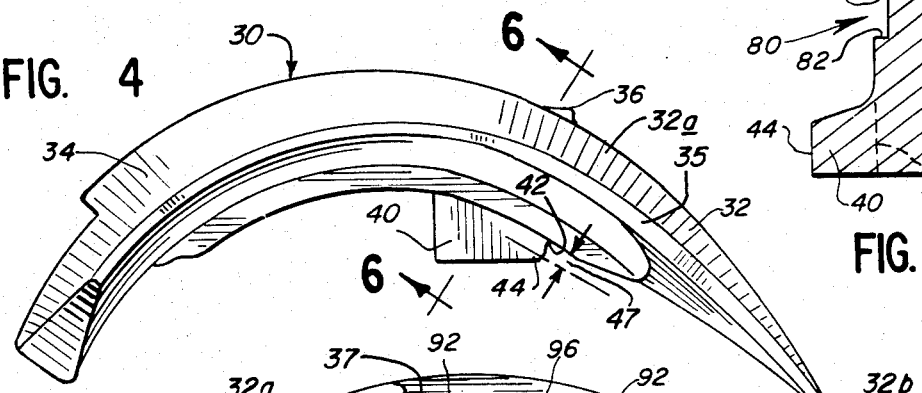
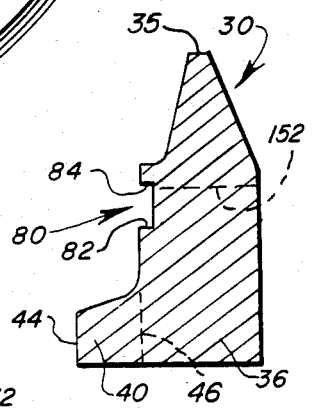
FIG. 6
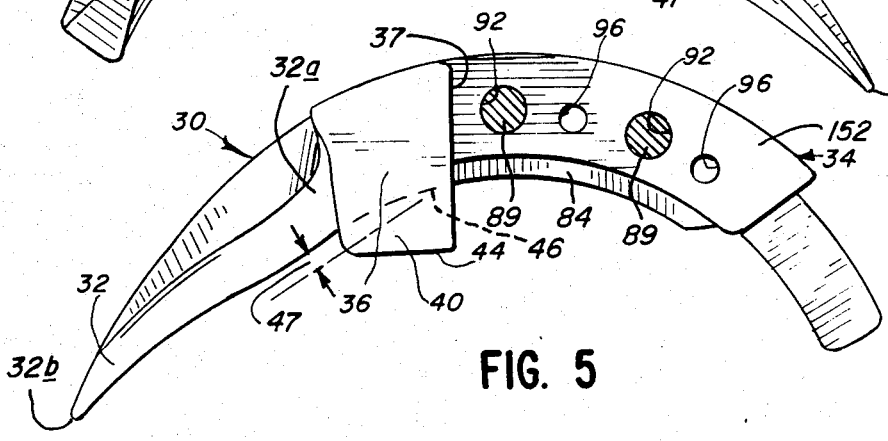
FIG. 5

122
100°
106F
80°
106E
106G
120
30'
60°
100
106D
120°
100
140°
30'
118
40°
35
109G
128
22'
106C
40
34'
58
56
32
160°
107G
130
20°
15
42
42a
106B
100
124
114
100
0°
180°
15
24
360°
74'
14
20
106A
200°
23
340°
116
340° OR -20°
100
220°
118
320° OR -40°
100
100
240°
300°
260°
280°
10'
30'
12
120
36
128
42
32a
34'
35
130
40
84'
12
44
47
32
36
128
30'
32a
156
120
32b
126
46
130
32
44
84'
40
34'
47
140
142
32b 11A
11A
35
30'
156
84'
80
82
120
36
44
40
46

12
148
34'
144
146
140

FIG. 13
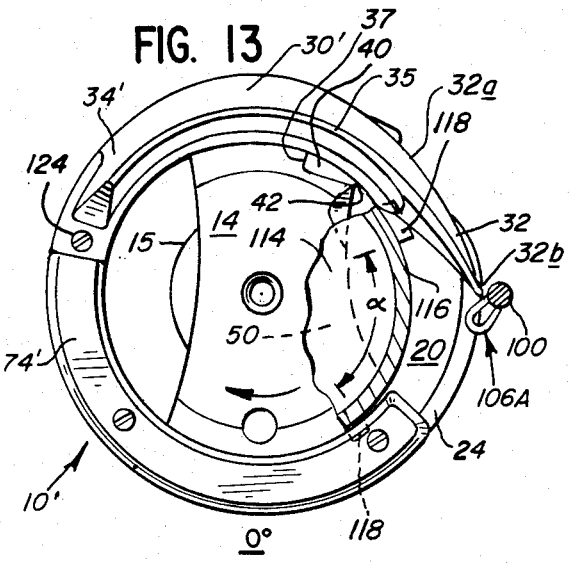
FIG. 14
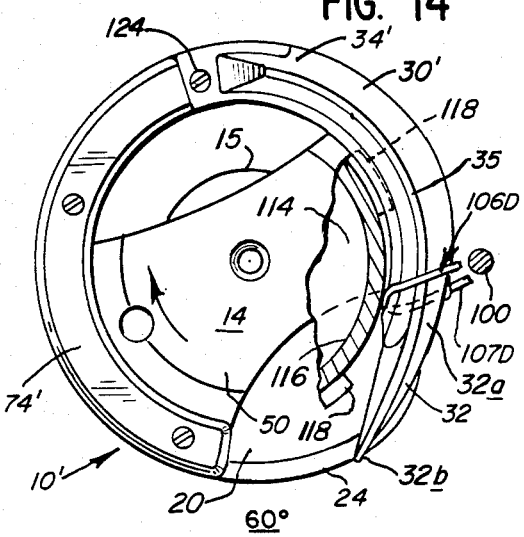
FIG. 15
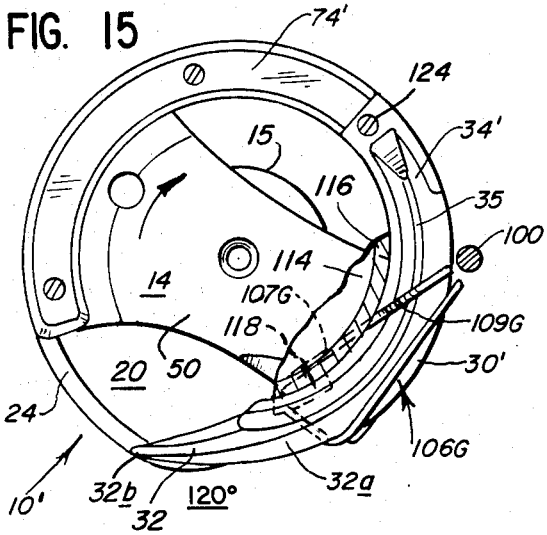
FIG. 16
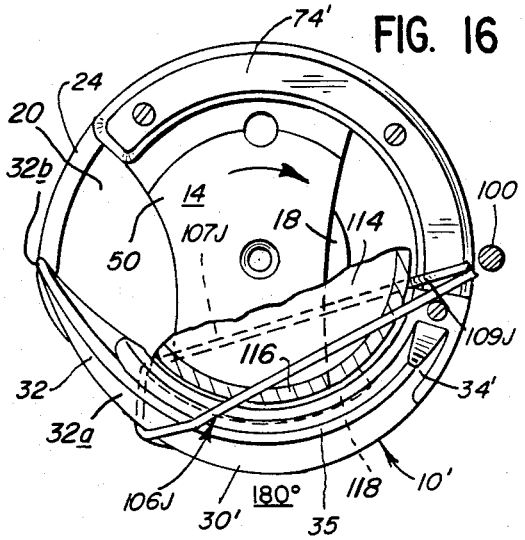
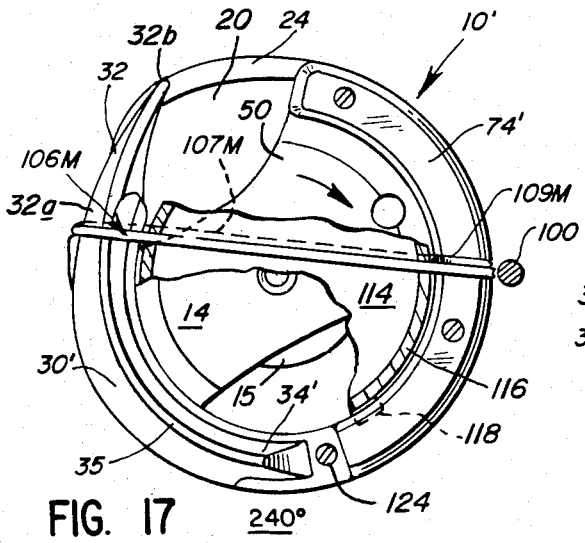
FIG. 17
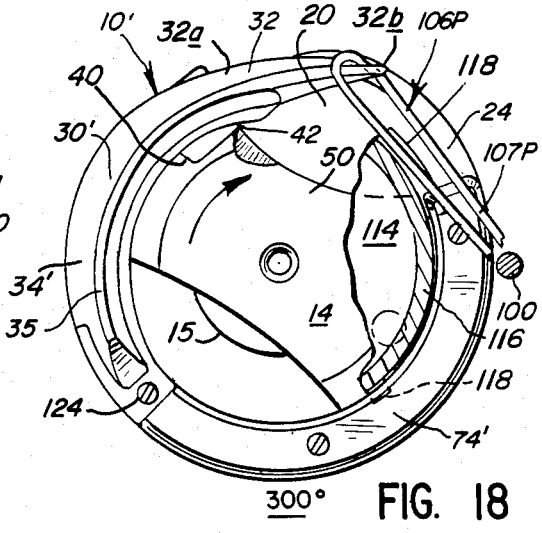
FIG. 18

FIG. 23
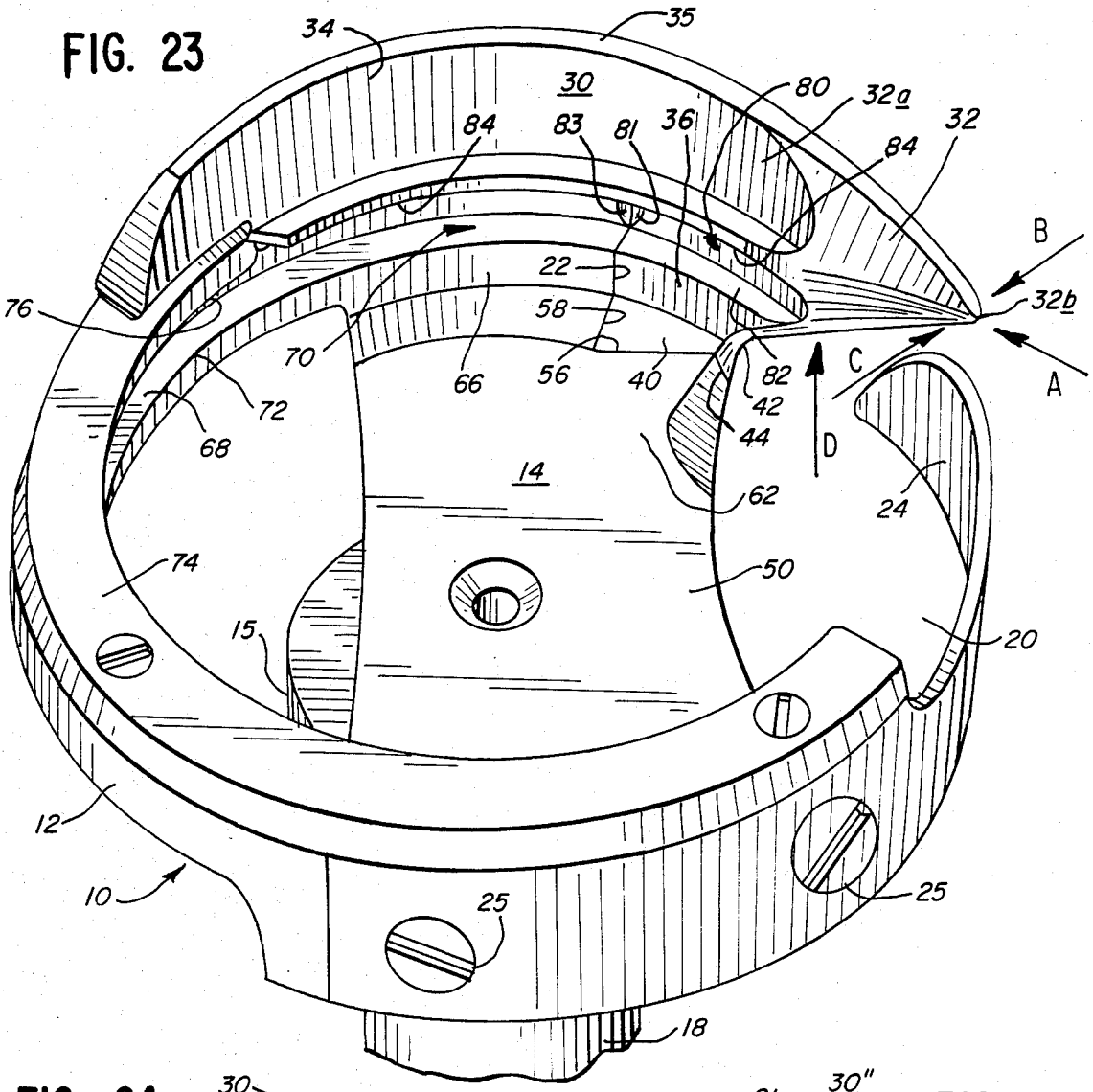
FIG. 24
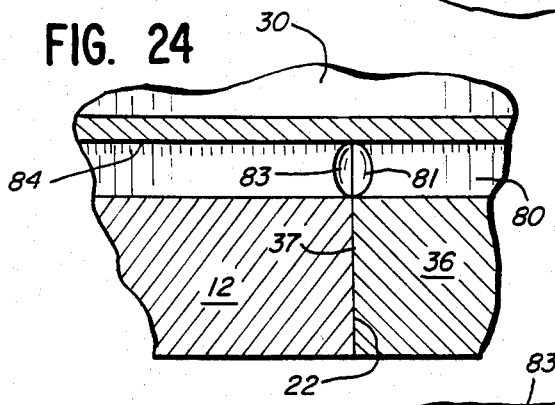
FIG. 25
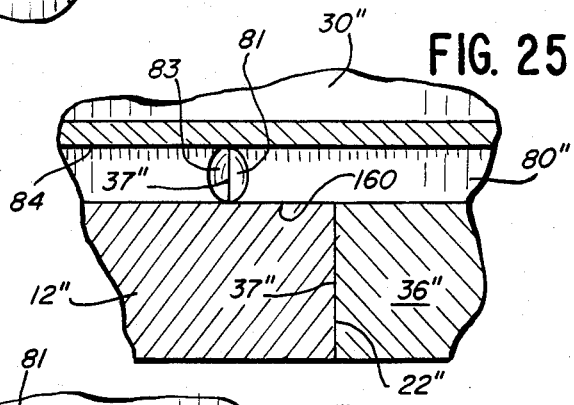
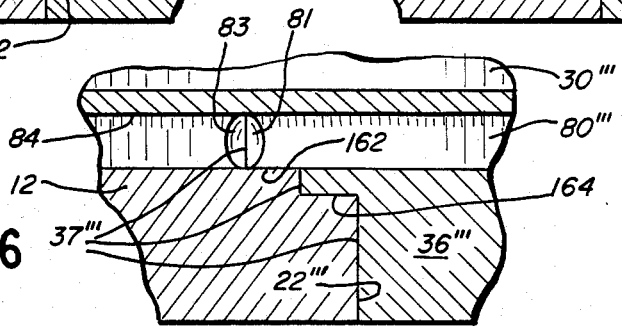
FIG. 26

ROTARY LOOP TAKER FOR LOCK-STITCH SEWING MACHINE

This application is a continuation-in-part of applicant's co-pending application for patent filed Mar. 5, 1982 and assigned Ser. No. 355,228, now abandoned which was in turn a continuation-in-part of applicant's then co-pending application filed Aug. 11, 1981 and assigned Ser. No. 292,036, now abandoned.

FIELD OF INVENTION

This invention relates to a rotary loop taker for use in a lock-stitch sewing machine in which the take-up device is located above the bobbin case, and in particular to such a loop taker that has a replaceable hook or loop seizing point.

BACKGROUND OF INVENTION

A rotary loop taker is a device that must be incorporated into all lock-stitch sewing machines. Perhaps 70 to 80 percent or more of all industrial sewing machines are of the lock-stitch type, and therefore utilize a rotary loop taker. Lock-stitch sewing machines of the type described are especially useful for sewing canvas, leather, or other heavy materials.

The conventional loop taker is precision machined of fine steel to accurate proportions and balance throughout its extent from its weighted hub to its fragile hook or "loop seizing point." It is a costly item, and a short-lived item under the heavy wear and tear that accompanies the use of a typical industrial sewing machine. Conventional loop takers have a life of only three to six months, depending on the many variables involved.

Because no one prior to applicant has understood how to construct a rotary loop taker with a detachable loop seizing point that is a satisfactory device, conventional loop takers are currently constructed—as they have been for more than 60 years—with the loop seizing point formed integrally with a substantially circular frame member and with a crosswise extending frame support member as well. This of course requires that when either the loop seizing point or the initial portion of the bobbin case raceway that is an important part of the rotary loop taker has become damaged, the entire loop taker must be discarded.

The most vulnerable part of the fragile loop seizing point of a rotary loop taker is the tip. The tip can, for example, be chipped by the needle of the sewing machine, or burred by the friction that is created by the high speed revolutions of the loop taker as it picks up the thread off the needle. Since a faulty hook or loop seizing point tends to skip stitches, it must be repaired or replaced whenever its fragile loop seizing point accidentally breaks or becomes too dull through normal wear.

With a rotary loop taker of the usual type, most factories simply discard the entire device when the loop seizing point (which as pointed out is conventionally an integrally formed part of the loop taker) becomes chipped or otherwise rendered unusable. Others send the rotary loop taker to a facility that reprocesses the tip of the loop seizing point at great time loss. Either expedient is very costly.

The advantages that would be provided by a rotary loop taker with a detachable loop seizing point that could be readily removed and replaced with a new point were recognized at least six decades ago. Dickson U.S. Pat. No. 1,431,380, issued Oct. 10, 1922 on an application filed Jan. 25, 1921, attempted to provide such a loop taker. However, for reasons to be discussed below, the loop taker disclosed in that patent was unsatisfactory, and so far as is known to applicant was never practiced commercially. Until applicant made his novel and important invention, no one so far as applicant is aware even developed a loop taker with a replaceable loop seizing point that satisfactorily met the extremely demanding conditions for use with known sewing machines. For this reason, until applicant's invention the extremely urgent need for loop takers with replaceable loop seizing points had never been successfully met despite the attempts by Dickson (and others discussed below who pursued alternative approaches) to produce such a device.

Loop takers of the conventional type are customarily provided with a circular raceway around the inner wall to accept a bearing rib located on the exterior of the bobbin case. It has long been recognized that with use this raceway invariably becomes flawed--especially in the initial portion of the raceway, which is the most vulnerable to damage—and in this condition restricts the free passage of the thread around the bobbin case. As a consequence of such damage to the raceway and resulting restriction of free passage of the thread, thread breakages frequently result. When this condition occurs, the entire rotary loop taker of conventional construction must be totally replaced.

Still another troublesome condition that results from the wearing of the bobbin case raceway in the conventional rotary loop taker is known in the industry as "slop." This condition is the excessive "play" between the bobbin case and the inner wall of the loop taker which defines the bobbin case raceway.

"Slop" interferes with the proper release of the top thread (i.e., the needle thread) from around the bobbin case, and increases the incidence of jamming between bobbin case and raceway. It also tends to cause large, undesirable loops of top thread to be formed on the bottom of the material being sewed, because of the premature closing of the escape exit for the top thread. It may also cause the top thread to break, if a bunching of thread occurs because of the degree of "slop" that is present. Finally, if the "slop" is great enough to produce serious jamming of the top thread, the upper ledge of the bobbin case raceway on the loop seizing point may be broken as the operator manipulates the bobbin case in an attempt to free up the jammed thread.

Shortly before the above mentioned Dickson patent issued, another patent was granted (Smith U.S. Pat. No. 1,415,268, issued May 9, 1922) that contained a good discussion of the problem in a revolving hook machine of replacing a damaged loop seizing point that is integrally formed with the rest of the rotary loop taker (page 3, lines 76–119). That patent attempted to solve the problem referred to by providing a vertically laminated hook in which the tip is secured to the rest of the hook by a set of screws and can be removed and replaced as required. (The term "vertically laminated hook" is used in this specification to refer to a loop seizing point that is laminated in layers that are parallel to the shaft of the rotary loop taker.) The device disclosed in the Smith patent was thus a detachable loop seizing point of an entirely different type from applicant's detachable hook.

Loop seizing points of vertically laminated construction unavoidably present cracks in which the needle thread loop can get caught, either in the operation of the sewing machine in a forward direction or (as is more or less common for certain purposes) in the reverse direction. Such laminated devices also present other cracks in which lint and dirt can be trapped. In addition, a vertically laminated loop seizing point is inherently weaker, and usually possesses less total mass and thus provides a less solid construction, than an integrally formed loop seizing point. Finally, some specialized hooks are so thin in the radial direction with respect to the annular supporting frame that vertical lamination is not feasible.

Despite these disadvantages, the approach of vertical lamination has been followed, ever since the Dickson patent was issued, in all but two industrial detachable loop seizing point patents that are known to applicant. Examples of detachable loop seizing points that are fabricated in vertically laminated form are the devices that are disclosed in the patents to Corrall et al. U.S. Pat. No. 2,002,172 issued May 21, 1935, Joseph U.S. Pat. No. 2,495,637 issued Jan. 24, 1950, Corey U.S. Pat. No. 3,140,681 issued July 14, 1964, Corey U.S. Pat. No. 3,223,060 issued Dec. 14, 1965, and Kuhar U.S. Pat. No. 3,465,700 issued Sept. 9, 1969.

The only prior art patents issued after the Dickson patent for rotary loop takers with detachable loop seizing points for use in an industrial sewing machine that do not follow the lamination approach that are known to applicant are Grabowski U.S. Pat. No. 3,139,050, issued June 30, 1964 and Thiermann German Pat. No. 933,601, issued Sept. 29, 1955. The detachable loop seizing point disclosed in the former patent is designed to be used with a sewing machine having a take-up device (ordinarily of the roller type) that is located below the bobbin case of the machine. So far as applicant is aware, the invention of the Grabowski patent has never been practiced with a lock-stitch sewing machine in which the take-up device (ordinarily of the link or rotary type) is located above the bobbin case of the machine.

Indeed, the complicated and expensive construction of the Grabowski detachable loop seizing point is entirely unsuited for use with a sewing machine in which the take-up device is located above the bobbin case, because of (1) the danger of interference with the exit of the needle thread from around the bobbin case that would be presented in such a sewing machine by any device such as the Grabowski device that includes a finger extending forward from the base of the loop seizing point; (2) the danger of the needle thread getting caught in the sharply constricted V-shaped throat portion 68 of the Grabowski type detachable loop seizing point if used in such a sewing machine; and (3) the basic difficulty, or even impossibility, of removing a damaged loop seizing point of this type from any such sewing machine of conventional construction by maneuvering it through the cramped spaces surrounding the rotary loop taker as the operator attempts to effect "the pivotal movement of the beak member 60" that is called for by the patent (col. 3, lines 12–13).

Although the Thiermann detachable loop seizing point is of integral rather than laminated construction, it has other shortcomings that render is impractical to use.

The patent to Abresky U.S. Pat. No. 2,491,022, issued Dec. 13, 1949, attempts to meet the problem of replacing a damaged loop seizing point by still another expedient, in which the hook tip is not detachable at all but is simply cut off when worn, broken or otherwise damaged. This patent discloses cutting off the damaged tip, replacing it by brazing a new tip of wear-resisting carbide to the hook, and then finish-grinding the brazed tip for smoothness. This is obviously a cumbersome, time-consuming and expensive method.

The loop taker of this invention overcomes all the disadvantages of the prior art discussed above.

SUMMARY OF THE INVENTION

The rotary loop taker of this invention, which is adapted for rotation about a generally cylindrical bobbin case maintained in a fixed position in a lock-stitch sewing machine below the take-up device of the machine, comprises a frame of substantially annular construction, means for rotatably supporting the frame, a detachable loop seizing point mounted on the frame, and means for detachably securing the loop seizing point to the frame. As the means for supporting the annular frame rotates during operation of the sewing machine, it rotates the frame about the fixed bobbin case in a predetermined plane, which plane may be horizontal, vertical or other, so long as the take-up device is above the bobbin case. When the means for supporting the annular frame is a rotatable shaft, a vertically oriented shaft will rotate the frame in a horizontal plane, and a horizontally oriented shaft will rotate the frame in a vertical plane.

The frame has a cut-away portion along one segment of its circumference, which portion is defined by opposing end walls of the frame facing upon the cut-away portion. The detachable loop seizing point has generally the same curvature as the substantially annular frame, and has a supporting lug that extends downward into the cut-away portion of the frame and at all times and throughout substantially the entire height of the lug abuts with at least a close fit, and preferably a snug fit, substantially the entire forwardly facing surface of the frame end wall that is at the trailing end of the cut-away portion during rotation of the shaft. The abutting relationship between the mass of the downwardly extending lug and the frame end wall just described, especially when the lug is nested (as described below) in a notch in a crosswise extending frame support member, provides solid and reliable support for the detachable loop seizing point.

The abutting surfaces of the downwardly extending supporting lug and the frame end wall at the trailing end of the cut-away portion of the annular frame are at least generally, and preferably substantially, normal to the outer circumference of the frame. The annular frame has a predetermined maximum thickness measured in the radial direction adjacent the trailing end of the cut-away portion during rotation of the frame, and the thickness of the lug, exclusive of the inwardly extending lug foot described below, measured in the same radial direction is preferably substantially equal to the predetermined maximum thickness of the frame. The depth of the downwardly extending lug and its length measured along the circumference of the annular frame are both preferably at least substantially equal to the predetermined maximum thickness of the frame. These dimensions provide a substantial mass for the lug and result in a stable and secure attachment of the loop seizing point to the frame that enables that detachable member to withstand the quite severe mechanical stresses to which it is subjected during operation of the sewing machine.

It is an important feature of the invention that the downwardly extending lug has a foot extending from the lower portion thereof inwardly towards the center of the annular frame, which provides a smoothly curved junction between the lug, the lug foot, and the base portion of the tapered forward end of the loop seizing point, thus presenting a solid seamless, jointless wall to the loop of needle thread that is taken us by the loop seizing point. This avoids snagging the thread in any cracks between the detachable loop seizing point and the loop taker frame. The smoothly curved junction between the lug, lug foot, and the forward end of the loop seizing point is preferably also gradually curved.

The lug foot advantageously extends inward from the lug a distance at least equal to the diameter of the largest thread with which the sewing machine is used. Good results are obtained if the lug foot extends inward from the lug at least about 1/32", and it is preferred that this dimension be at least about 1/16". This again helps to avoid snagging the loop thread that is taken up by the rotary loop taker.

If no lug foot is included in the rotary loop taker of this invention, other means should preferably be provided to keep the thread from snagging, such as, for example, stem 39 disclosed in U.S. Pat. No. 2,866,425 to Palmbach.

In addition to avoiding the snagging of the needle thread, the provision of a foot extending inwardly from the lower portion of the downwardly extending supporting lug of the loop seizing point helps to achieve a secure and firm attachment of the seizing point to the substantially annular frame of the rotary loop taker. It accomplishes this by widening the bottom portion of the downwardly extending support lug to produce a greater mass of material in the lug, and at the same time to increase the area over which the rearwardly facing surface of the lug and the forwardly facing surface of the frame wall defining the cut-away portion of the frame are in contact.

The loop seizing point has a single continuously tapered, or reduced, smoothly shaped integrally formed forward end or tip that extends forwardly of the downwardly extending lug into the cut-away portion of the frame, with no other projection extending forwardly of said lug. A rear portion of the loop seizing point extends rearwardly of the lug along the annular frame, preferably about as far rearwardly of the downwardly extending lug as the reduced forward portion extends forward of the lug.

The detachable loop seizing point is integrally formed from one end to its other end. The over-all length of the loop seizing point from the tip of its forward end to the end of its rear portion is a minor portion, suitably about one-third and preferably about one-quarter, of the circumference of the annular frame.

In a preferred embodiment of the invention, a frame support member mounted on a rotatable shaft extends crosswise of the annular frame, and one edge portion of the crosswise extending support member faces the cut-away portion of the frame to define a notch at the end thereof that is the trailing end of that edge portion during rotation of the shaft. This notch has a first wall that is generally parallel to the circumference of the annular frame, and a second wall that is generally radially positioned with respect to the frame. The notch extends inwardly from the frame towards the shaft. In this embodiment, the inwardly extending lug foot extends into the notch in the edge portion of the crosswise support member to nest within the notch.

It is also preferred that at least the surface portion of the crosswise support member that lies opposite the surface thereof to which the shaft is attached and defines the first wall of the notch forms a close fit, and for improved results a snug fit, with the inwardly extending lug foot. Best results in avoiding any crack in which the needle thread can get snagged or trapped are obtained when the the first wall of the notch forms a snug fit throughout its entire extend with the inwardly extending lug foot.

Best results in providing a firm, secure attachment of the loop seizing point to the annular frame of the rotary loop taker are obtained when the walls of the notch fit snugly against the rearwardly facing and inwardly facing surfaces, respectively, of the downwardly extending supporting lug. This nesting of the lug and its inwardly extending foot within the notch that is formed in the annular frame and the crosswise extending frame support member contributes to forming a firm and secure attachment of the loop seizing point to the annular frame or base of the rotary loop taker by increasing the area of the abutting surfaces on the lug, the lug foot, and the walls that form the notch.

As in rotary loop takers of conventional construction, the middle and final portions of the raceway for accepting the radially extending rib of the bobbin case are defined by a lower ledge on the inner wall of the frame member and an upper ledge provided by a gib that is typically detachably secured to the frame. The detachable loop seizing point of this invention has an inner wall that carries an upper ledge defining the upper part of an initial portion of the bobbin case raceway. Preferably the upper ledge carried by the inner wall of the loop seizing point defines the upper part of the entire initial portion of the bobbin case raceway. The bottom surface of the upper ledge lies in substantially the same plane throughout the entire extent of the ledge. In addition, it is preferred that the inner wall of the loop seizing point carry a lower ledge that defines the lower part of the initial portion of the bobbin case raceway.

Another source of strength and stability in the attachment of the loop seizing point to the substantially annular frame of the rotary loop taker of this invention is the selection of the height to which the rearwardly facing surface of the downwardly extending supporting lug rises. The initial portion of the bobbin case raceway is a very important portion of the raceway, and thus it would be expected that the interruption of the lower ledge and the vertical wall between the upper and lower ledges of the raceway in that area should be minimized by placing the top boundary of the rearwardly facing surface of the supporting lug at some distance below the top of the lower ledge.

Applicant has unexpectedly discovered that it is more important to increase the mass of the lug and the area of contact between the rearwardly facing surface of the lug and the generally radially oriented wall of the notch, and that an effective way to accomplish this is to place the top boundary of the rearwardly facing surface of the lug at about the bottom of the upper ledge of the raceway. This positioning of the top boundary of the rearwardly facing surface of the downwardly extending supporting lug has the additional advantage that it brings a substantial portion of the lug up to the vicinity of the vertical midpoint of the base portion of the tapered forward end of the detachable loop seizing point.

Means is provided for reliable and accurate attachment of the loop seizing point to the frame. This attachment means is located entirely rearward of the reduced forward end of the loop seizing point. In one embodiment of the rotary loop taker of this invention, screw means attach the loop seizing point securely to the frame, and studs with complementary holes provide accurate alignment of these parts.

The use of one or more aligning studs and cooperating screw members, with sharp restriction of the number of abutting surfaces on the loop seizing point itself and on the remainder of the rotary loop taker, accurately aligns the loop seizing point both horizontally and vertically in relation to the annular frame. The limitation of the number of abutting surfaces that have vertical components simplifies and makes more reliable the horizontal alignment of the loop seizing point, and the limitation of the number of abutting surfaces that have horizontal components accomplishes the same thing with respect to the vertical alignment of the loop seizing point.

It is preferred that the loop seizing point be secured to the annular frame by releasable means that when released permits initial separation of the loop seizing point from the frame without any movement in a radial direction with respect to the frame, followed by an inward tilting of the top of the loop seizing point and an outward tilting of the bottom of the loop seizing point to clear the loop seizing point both of the bobbin case and of the surrounding parts of the sewing machine for removal of the loop seizing point from its frame. It is further preferred that the securing means be located in an exposed position accessible to the operator from outside the sewing machine without removing any other part of the rotary loop taker or any other part of the machine. In one such embodiment, the securing means includes a protuberance in the form of a positioning and restraining post on the rear surface of the downwardly extending supporting lug and a complementary cavity on the frame end wall at the trailing end of the cut-away portion, together with releasable anchoring means at the rear end of the detachable loop seizing point for securing that rear portion to the annular frame.

The loop seizing point described just above is defined in the claims both in combination with the other elements of the rotary loop taker and as a subcombination of the whole invention. The rotary loop taker may be manufactured and sold as a complete product, or separate loop seizing points may be manufactured and sold as replacement parts for use when the original loop seizing point becomes worn, chipped or otherwise damaged.

Many advantages are provided by the rotary loop taker and loop seizing point of this invention. These include:

When the fragile loop seizing point becomes damaged through use, the user can attach a new loop seizing point to the remainder of the rotary loop taker, which means a very considerable savings in materials and a resultant marked cost reduction.

The preferred embodiment of the replaceable loop seizing point includes a new initial portion of the bobbin case raceway, which is the most vulnerable part of the raceway and thus a major cause of replacement of conventional loop takers.

When it is desired to buff burrs or minor abrasions on the loop seizing point, it may be removed from the frame or base and all parts of the loop seizing point are then much more easily accessible.

The incidence of "slop", or undesirable "play" between the bobbin case and the loop seizing point, can be greatly reduced (as will be explained in more detail below) because of the greater ease of replacing only the loop seizing point—including a new initial portion of the bobbin case raceway—instead of having to replace the entire rotary loop taker.

It is easier with the rotary loop taker of this invention to remove thread lock, which occurs when thread gets jammed between the bobbin case and its raceway. Because of the ease with which the rotary loop taker of this invention can be disassembled and reassembled, any thread lock can be easily rectified.

The sewing machine user can employ different types of tips on the original frame or base of the rotary loop taker of this invention to meet specific sewing needs.

With the preferred form of the invention, the detachable loop seizing point can in all cases be removed from the rest of the rotary loop taker by the operator without removing the loop taker from the sewing machine, which makes replacement of the loop seizing point significantly easier and faster.

The user will have greater production time per dollar expended for this rotary loop taker as compared to the conventional loop takers that have been in use for many decades.

The rotary loop taker of this invention should have a period of use, with replaceable loop seizing points, several times longer than with conventional rotary loop takers.

The ability to replace a loop seizing point—including the initial portion of the bobbin case raceway—whenever it is necessary to do so provides insurance that the remainder of the rotary loop taker can be continued in use until it becomes so worn or damaged in some other regard that it is no longer usable.

The manufacturer of the rotary loop taker should find the fabrication of the rotary loop taker of this invention—with its two-piece construction—very much easier and therefore considerably less expensive than the fabrication of the conventional integrally formed rotary loop takers.

BRIEF DESCRIPTION OF THE DRAWINGS

This invention will now be described with reference to the attached drawings in which:

FIG. 1 is an enlarged, three-quarters perspective view from the top of one embodiment of the rotary loop taker of this invention;

FIG. 2 is a side elevation of the rotary loop taker of FIG. 1;

FIG. 3 is a top plan view of the rotary loop taker of FIG. 1 with the detachable loop seizing point removed for clarity;

FIG. 4 is a top plan view of the detachable loop seizing point of the rotary loop taker shown in FIGS. 1 and 2;

FIG. 5 is a bottom plan view of the loop seizing point of FIG. 4;

FIG. 5 is a bottom plan view of the loop seizing point of FIG. 4, with screw means for securing the same to the remainder of the rotary loop taker shown in section;

FIG. 6 is a cross sectional view of the loop seizing point of FIG. 4, taken along the line 6—6 of the latter Figure;

FIGS. 13 through 18 are top plan views of the rotary loop taker of FIG. 7, showing the needle in its fixed horizontal position, and the rotating loop taker and the needle thread loop that has been taken up by it in the approximate successive positions occupied by them as the rotary loop taker goes through one full rotation after it has taken up the thread loop;

FIG. 23 shows diagrammatically various distorting and destructive forces to which the rotary loop taker of FIG. 1 is subjected;

FIG. 24 is a fragmentary sectional view of the loop seizing point of FIG. 6 installed in place on the annular frame of the rotary loop taker, taken along the line 24—24 of FIG. 1;

FIG. 25 is a fragmentary cross sectional view of the loop seizing point of FIG. 20 installed in place on the annular frame of the rotary loop taker, taken along the line 25—25 of the latter FIG.; and FIG. 26 is a fragmentary cross sectional view of the loop seizing point of FIG. 22 installed in place on the annular frame of the rotary loop taker, taken along the line 26—26 of the latter FIG.

DETAILED DESCRIPTION OF TWO EMBODIMENTS

General Construction of Rotary Loop Taker

Figure 7:
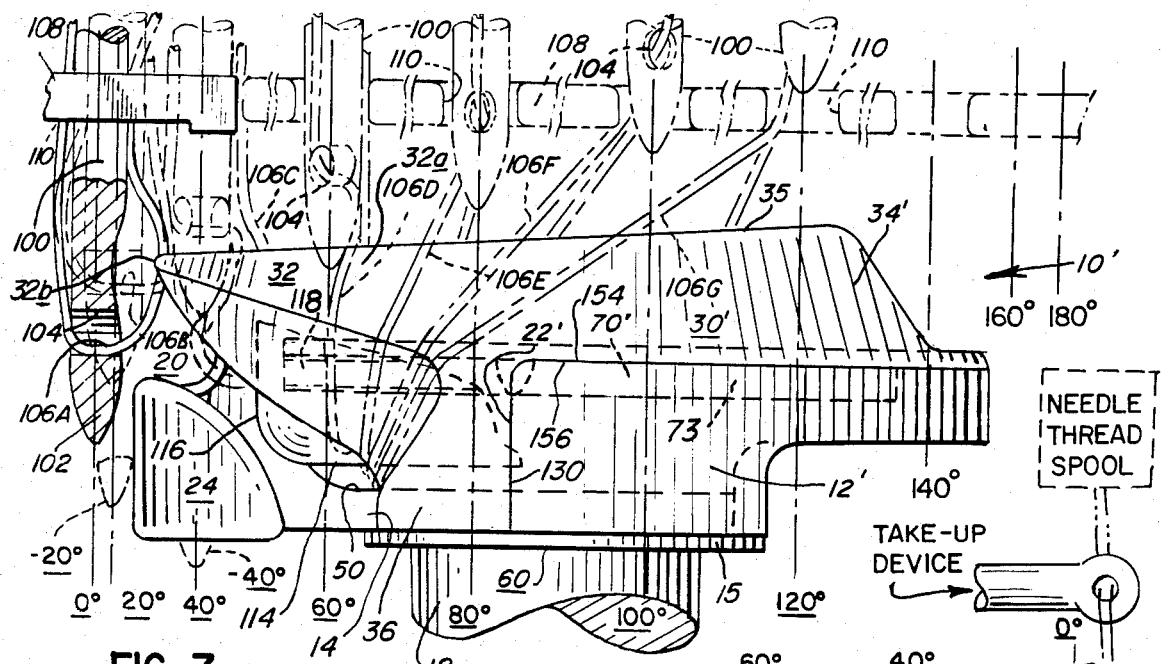
FIG. 7 is similar to FIG. 2, with an alternative means of securing the detachable loop seizing point to the annular frame of the rotary loop taker, with the addition of a needle and its associated thread shown in full line just before the rotary loop taker takes a loop of needle thread off the needle, and with successive relative positions of the needle and needle thread loop with respect to the rotating loop taker shown in phantom.

FIG. 1 is an enlarged, three-quarters perspective view of one embodiment of the rotary loop taker of this invention, indicated by the numeral 10, in the vertical position it occupies when in place in a lock-stitch sewing machine of conventional construction in which the take-up device (not shown) in this Figure is located above the bobbin case (also omitted for clarity except for certain fragmentary showings explained below) of the machine.

Loop taker 10 includes substantially annular frame 12, which is supported by crosswise support member 14 extending from one side of the frame to the other. Crosswise support member 14 is in turn attached to shaft 16, at generally right angles thereto, through disk 15 and hub 18. When this embodiment of rotary loop taker 10 is in use in a lock-stitch sewing machine, shaft 16 is oriented in a vertical position.

As seen in FIG. 2, shaft 16 is attached, through hub 18 and disk 15, to the bottom surface in that Figure of crosswise extending support member 14. This arrangement of parts provides means for rotatably supporting frame 12 in the lock-stitch sewing machine. Shaft 16 is in turn connected to the actuating mechanism of the sewing machine, and during use of the machine is rotated to cause frame 12 to rotate in a predetermined plane about the associated bobbin case.

A portion of substantially annular frame 12 is cut away along one segment of its circumference. Cut-away portion 20 of frame 12 is best seen shown in phantom in FIG. 3. As there seen, opposing end walls 22 and 23 of frame 12 face upon, and define, cut-away portion 20.

In a lock-stitch sewing machine the needle penetrates the material being sewed and when it starts to withdraw from that material forms on the underside of the material a loop of needle thread which is hooked by the loop seizing point of the rotary loop taker as the latter begins a revolution. The loop of needle thread is then passed around the bobbin case as the loop taker rotates, to be pulled off by the take-up device near the end of a full revolution of the loop taker. Cut-away portion 20 of frame 12 provides space for the needle thread to exit from the loop seizing point and to be pulled away from the bobbin case as rotary loop taker 10 completes its revolution and the needle thread is pulled off the loop seizing point by the take-up device. The successive positions of the needle thread loop as the rotary loop taker revolves are illustrated in FIGS. 7 through 9 and 13 through 18, discussed below.

Needle guard 24 extends from frame 12, to which it is attached by screws 25, into frame cut-away portion 20.

Loop Seizing Point With Downwardly Extending Lug

Detachable loop seizing point 30 is mounted on frame 12. It has generally the same curvature as substantially annular frame 12. Tapered or reduced forward end 32 extends into cut-away portion 20 of frame 12, and rear portion 34 extends in the other direction along annular frame 12.

Tapered forward end 32 includes base portion **32*a*, which portion has the broadest transverse dimensions of member 32. Member 32 tapers from the base portion to its smallest transverse dimensions at its free end 32*b***.

Lug 36 extends directly downward from detachable loop seizing point 30, generally midway between the front and rear ends of the loop seizing point, from immediately behind base portion 32*a* of forward end 32. The lug extends into cut-away portion 20 of frame 12, and its rearwardly facing surface 37 abuts end wall 22 of the frame, which is at the trailing end of cut-away portion 20 during rotation of shaft 16 in the clockwise direction as seen in FIG. 1 during operation of the sewing machine.

Except for the detachable nature of the loop seizing point, the rotary loop taker thus far described is conventional in the industrial sewing machine industry. As pointed out above, Dickson U.S. Pat. No. 1,431,380 indicates that as long ago as 1921 (when the application for that patent was filed) persons skilled in the art of industrial sewing attempted to provide a rotary loop taker with a detachable loop seizing point, but for reasons to be discussed below the attempt failed, and no one in the intervening 60 years has devised a workable device such as is provided by applicant's invention.

Form and Dimensions Of Loop Seizing Point

Detachable loop seizing point 30 is integrally formed from reduced forward end 32 to the rear end of rear portion 34. Tapered forward end 32, which extends forwardly of downwardly extending lug 36, is a single, smoothly shaped, integrally formed element. Loop seizing point 30 has no other projection extending forwardly of lug 36. Rear portion 34 extends rearwardly of lug 36 approximately as far as tapered forward end 32 extends forward of the lug.

The over-all length of loop seizing point 30 measured from the tip of its forward end 32 to the rear end of rear portion 34 may be a minor portion of the circumference of annular frame 12. In the embodiment shown in FIGS. 1 through 6 and the embodiment shown in FIGS. 7 through 12, the over-all length of loop seizing point 30 is approximately one-third of the circumference of frame 12. Loop seizing point 30 may advantageously be only approximately one-quarter of the circumference of frame 12 in length. In some embodiments, it may be somewhat more than a minor portion of the circumference of the frame.

The loop seizing point should be approximately as long as indicated for three reasons. First, no breaks in the surface of the loop seizing point should be interposed in the path that is followed by the loop of needle thread as it is picked up from the needle and is slid back along forward end 32 toward downwardly extending lug 36, and across top ridge 35 of the loop seizing point and the top surface of gib 74 (as best seen in FIGS. 7 through 9 and 12 through 18, discussed below). Second, rear portion 34 of the loop seizing point should be substantial enough in size to provide a secure attachment to frame 12. Third, for convenience of manufacture and installation, the loop seizing point should be no longer than is required by the first two considerations just mentioned.

As is seen by a comparison of FIGS. 3 and 4, the maximum thickness of base portion 32*a* of tapered forward end 32 of loop seizing point 30 measured radially of annular frame 12 adjacent downwardly extending supporting lug 36 is substantially equal to the maximum thickness of frame 12 measured in the same radial direction. This will help provide strength, rigidity and stability in tapered forward end 32 under the rigorous conditions of use in a typical commercial lock-stitch sewing machine.

Form and Dimensions Of Downwardly Extending Lug

As stated above, rearwardly facing surface 37 of downwardly extending lug 36 abuts end wall 22 of frame 12, which is at the trailing end of cut-away portion 20 during forward rotation of the frame. Since loop seizing point 30 is secured to frame 12 in a fixed position, this abutting relationship continues at all times. As is shown by FIGS. 1, 2, 7 and 8, this abutting relationship also extends throughout substantially the entire height of supporting lug 36, and throughout substantially the entire forwardly facing surface of frame end wall 22 as well.

Lug 36 and the surface of end wall 22 against which it abuts form at least a close fit at all times, and preferably a snug fit. The abutting surfaces of lug 36 and frame end wall 22 are generally normal, and preferably substantially normal, to the outer circumference of annular frame 12.

As will be seen, the abutting relationship between the mass of downwardly extending lug 36 and frame end wall 22 provides a solid and reliable support for detachable loop seizing point 30. For best results, it is important that this mass be quite substantial in order for a sufficiently stable and secure attachment to be effected between loop seizing point 30 and frame 12 that detachable member 30 will be able to withstand the quite severe mechanical stresses to which it is subjected during normal operation of a commercial sewing machine. Thus, it is preferred that the maximum thickness of lug 36, exclusive of inwardly extending lug foot 40 to be described below, measured radially of annular frame 12 be substantially equal to the maximum thickness of frame 12 measured in the same direction (FIG. 3). It is further preferred that the length of lug 36 measured along the outer circumference of annular frame 12 be at least substantially equal to the maximum radial thickness of frame 12, and that the depth of the downwardly extending lug measured axially of frame 12 also be at least substantially equal to the radial maximum thickness of the frame.

The fragmentary perspective view in FIG. 24 provides a further illustration of the abutting relationship in the embodiment of FIGS. 1 to 6 between the forwardly facing surface of end wall 22 of frame 12 and the rearwardly facing surface 37 of downwardly extending supporting lug 36 of loop seizing point 30.

Figure 19:
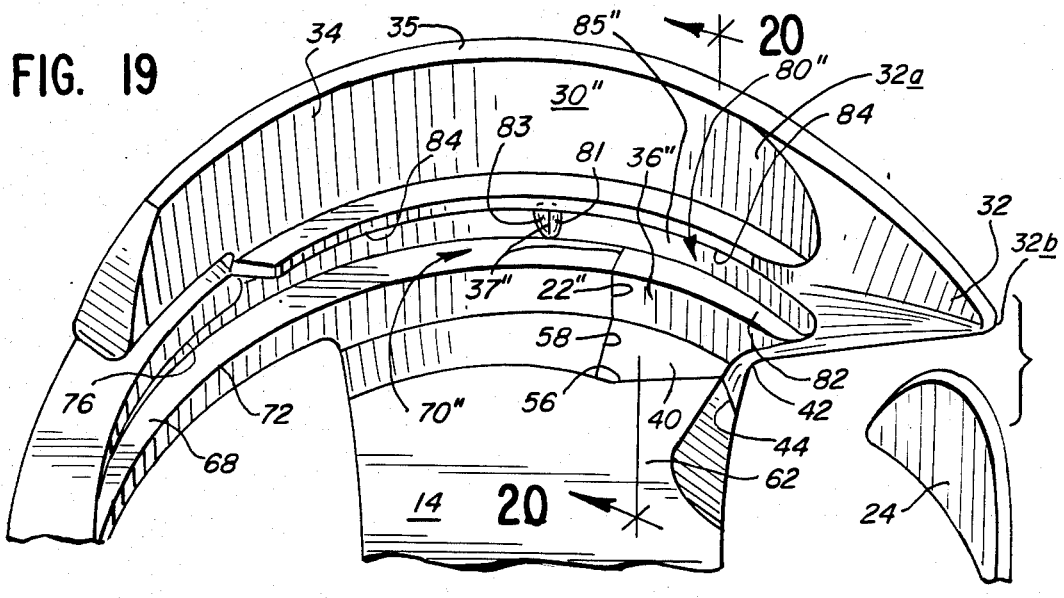
FIG. 19 is a fragmentary, enlarged, three-quarters perspective view from the top of an alternative embodiment of the rotary loop taker of FIG. 1.
Figure 21:
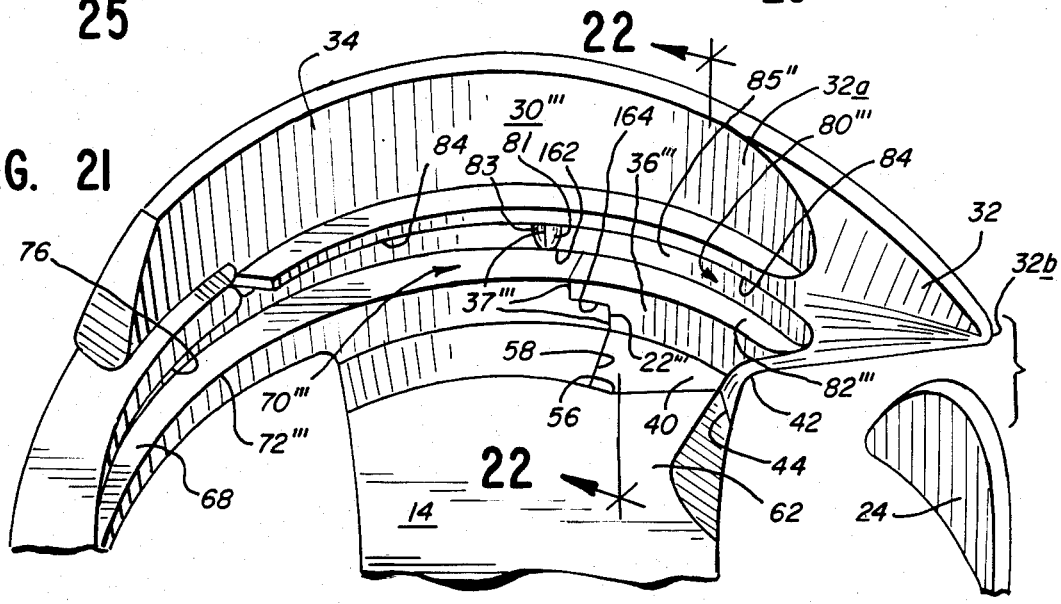
FIG. 21 is a view similar to FIG. 19 of another alternative embodiment of the rotary loop taker of FIG. 1.

FIGS. 19 and 21 provide fragmentary perspective views of embodiments in which the rearwardly facing surface of downwardly extending supporting lug 36 has a stepwise shape. In FIGS. 19 and 25, stepwise disposed surfaces 37″ constitute the rearwardly facing surface of lug 36″. In FIGS. 21 and 26, surfaces 37‴ constitute a stepwise rearwardly facing surface of lug 36‴. If desired, for greater ease of manufacture (i.e., less strict tolerances required) the upper portions of rearwardly facing surfaces 37″ and 37‴, respectively (which constitute a minor fraction of the total rearwardly facing surface in each case) may be fabricated to fit the forwardly facing surfaces they abut with a fit that is slightly less tight than the fit with which the lower portions thereof abut the remainder of frame end wall 22.

Figure 20:
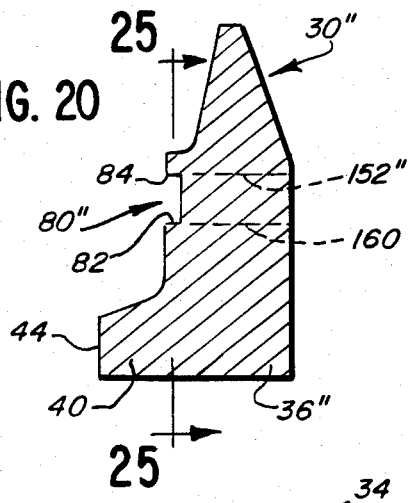
FIG. 20 is a cross sectional view of the loop seizing point of FIG. 19, taken along the line 20—20 of the latter FIG.
Figure 22:
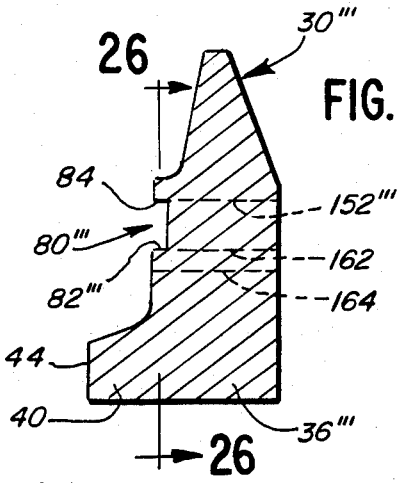
FIG. 22 is a cross sectional view of the loop seizing point of FIG. 21, taken along the line 22—22 of the latter FIG.

IN FIG. 20, downwardly facing surfaces 152″ and 160 perform the same function as downwardly facing surface 152 in the embodiment of FIGS. 1 through 6. In FIGS. 21 and 22, downwardly facing surfaces 152''', 162 and 164 perform the same function as downwardly facing surface 152 of the FIGS. 1–6 embodiment. FIGS. 24 through 26 further illustrate these facts. If desired, for greater ease of manufacture, downwardly facing surfaces 160, 162 and 164 may be fabricated to fit the respective upwardly facing surfaces directly beneath them with a fit that is slightly less tight than the fit between downwardly facing surfaces 152'' and 152''' and the respective upwardly facing surfaces directly beneath them.

(In FIGS. 19, 20 and 25, the initial portion of the bobbin case raceway is designated by the numeral 80''. In FIGS. 21, 22 and 26, the initial portion of the bobbin case raceway is designated by the numeral 80'''.)

Inwardly Extending Foot On Loop Seizing Point Lug

An important feature of the rotary loop taker of this invention is the provision of a foot 40 extending inwardly toward shaft 16 from the lower portion of lug 36. During operation of the sewing machine, loop seizing point 30 is carried in a clockwise direction as seen in FIG. 1 by rotation of shaft 16, and takes a loop of thread off the needle (as best seen in connection with loop seizing point 30' in FIGS. 7 through 9 and 12 through 18). The loop of thread that is taken off the needle in this way slides from the narrow tip 32 of loop seizing point 30 or 30' (in FIGS. 1–6 and 7–18, respectively) down towards junction 42.

In the embodiment of FIGS. 1–6, end wall 44 of inwardly extending lug foot 40 protrudes from frame 12 and lug 36 (indicated at 46 in FIGS. 5 and 6) a distance 47 at least equal to the diameter of the largest thread with which the sewing machine is used. As a consequence, the loop of thread carried by rotating loop seizing point 30 is not tangled in any way with any aperture on the loop seizing point, which avoids the thread snagging and breakage that is discussed above. The loop thread can therefore readily slide off loop seizing point 30 after it has been carried the requisite angular distance by rotation of the point.

Thread employed in an industrial sewing machine runs typically from about 1/32" to about 3/64" in thickness. Thus lug foot 40 may extend inward from lug 36 advantageously at least about 1/32 inch, and improved results are obtained if it extends inward from lug 36 at least about 1/16 inch.

Smoothly Curved Junction

As is best seen in FIGS. 1, lug foot 40 extends inwardly from the lower portion of lug 36 towards the center of annular frame 12 to provide a smoothly curved junction 42 without any seams or joints between lug 36, foot 40, and base portion 32*a* of tapered or reduced, smoothly formed forward end 32 that extends forwardly of lug 36. As will be pointed out in the discussion below of FIGS. 7 through 18, this is of great importance in avoiding any possibility of snagging the loop of needle thread that is carried around by the rotating loop taker.

As shown in FIGS. 1, 2, 7 and 8, smoothly curved junction 42 between lug foot 40 and tapered forward end 32 is preferably gradually curved.

Inwardly Extending Lug Foot Nested In Crosswise Support Member

As is best seen from FIG. 3, edge portion 50 of crosswise extending support member 14 faces cut-away portion 20 of annular frame 12. End 52 of edge portion 50 defines notch 54 at the end of the edge portion that is the trailing end during rotation of shaft 16 in the clockwise direction. First wall 56 of notch 54 is generally parallel to the circumference of frame 12. Second wall 58 of notch 54 is positioned generally radially with respect to annular frame 12. Notch 54 extends inwardly from the inner circumference of frame 12 towards shaft 16 to a location inward of the frame.

As seen in FIG. 1, inwardly extending lug foot 40 extends into notch 54 in edge portion 50 of crosswise support member 14. Lug foot 40 and notch 54 are arranged in nesting relationship.

Surface portion 62 of edgewise portion 50 and inwardly extending lug foot 40 form, as shown in FIG. 1, at least a close fit, and preferably a snug fit. Best results are obtained when first wall 56 of notch 54 forms a snug fit throughout its entire extent with inwardly extending lug foot 40.

The parts of this invention just described are arranged in the indicated manner to minimize the risk of a thread loop picked up by tip 32 of loop seizing point 30 becoming snagged in a gap that is located too close to downwardly extending lug 36. The failure to appreciate the critical importance of this feature is evidently one of the main reasons for the failure of the Dickson prior art device. From the various Figures of the Dickson patent, it is clear that that device both courted snagging of the needle thread as the loop taker rotates, and failed to take advantage of the added strength and stability that in the present invention results from the provision of the nesting of downwardly extending supporting lug 36 within notch 54 in frame 12 and front edge portion 50 of crosswise support member 14.

Rotation Of Loop Taker Adjacent Vertically Reciprocating Needle

The great importance of inwardly extending foot 40 and the smoothly curved junction 42 without any seams or joints that it forms with downwardly extending support lug 36 and base portion 32*a* of tapered forward end 32 of loop seizing point 30 in avoiding getting needle thread loops caught or snagged, as just mentioned, can best be understood by reference to FIGS. 7 through 9 and 12 through 18. These Figures illustrate how forward end 32 of loop seizing point 30 of rotary loop taker 10 picks up a loop of needle thread as it rotates past needle 100, and carries the loop around until it is released near the end of one full revolution of the loop taker.

In FIG. 7, needle 100 is shown in the upper left-hand corner of the Figure with the lower portion 102 of the needle in cross section so as to outline needle eye 104, through which needle thread loop 106 passes. Throat plate 108 (which is part of the sewing machine table) is shown positioned above rotary loop taker 10', with the slide plate (which covers the bobbin case and rotary loop taker during operation of the sewing machine) omitted for clarity. Needle 100 passes through aperture 110 in throat plate 108 as it follows the vertically reciprocating path now to be described.

In industrial sewing machines of the "drop feed" type, which are ordinarily used for sewing lightweight fabrics or other lightweight materials, the needle moves up and down vertically but is wholly stationary in all horizontal directions. In machines of the "needle feed" type, which are ordinarily used for sewing heavier weight materials, in addition to its vertical movement the needle moves back and forth horizontally a short distance to help move the material along as it is being sewn. The rotary loop taker of this invention may be used with sewing machines of either type, but for illustrative purposes it is shown in FIGS. 7 through 9 and 13 through 18 in the accompanying drawings as used with a machine of the drop feed type.

Figure 8:
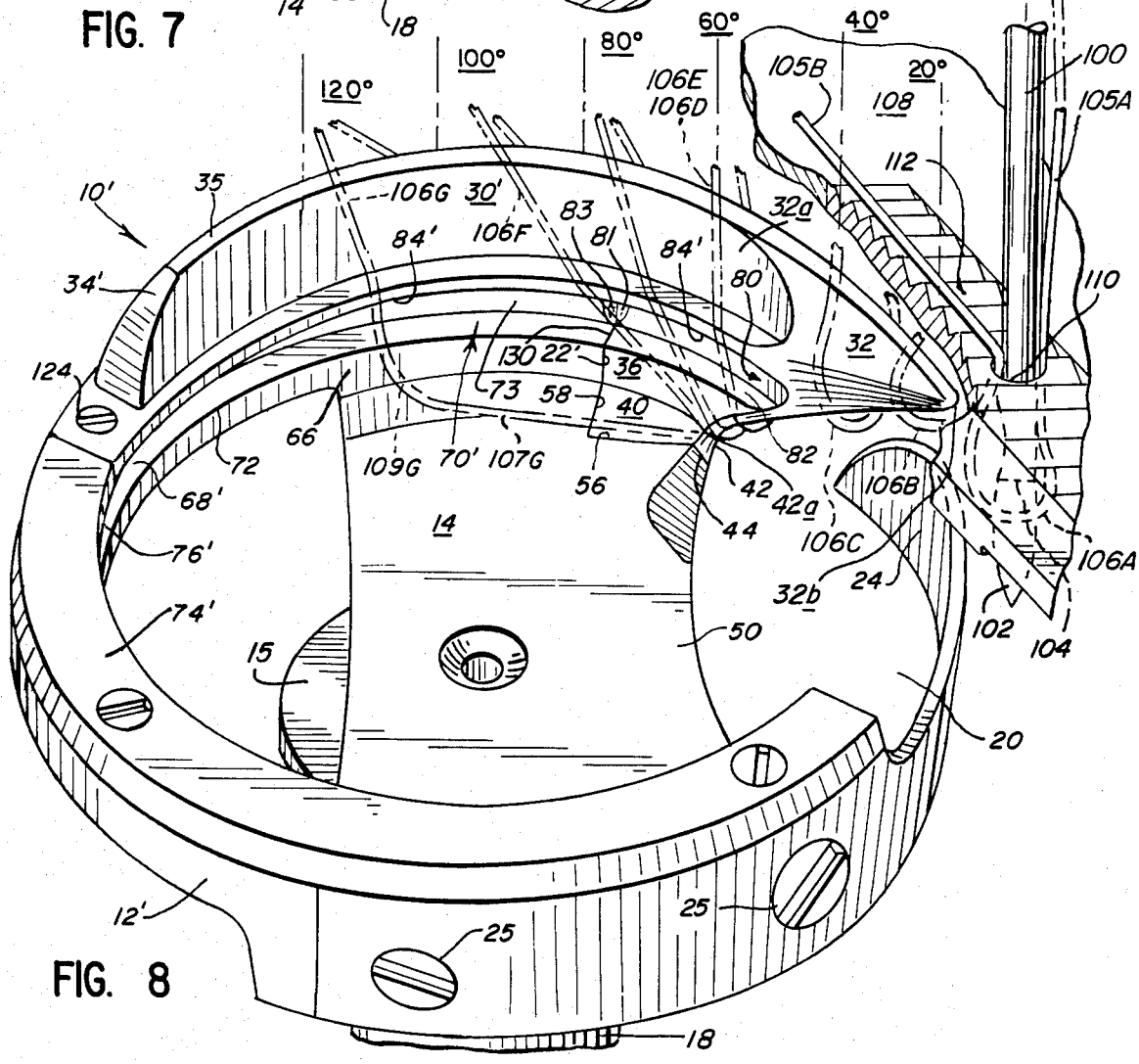
FIG. 8 shows the embodiment of FIG. 7 in a view similar to FIG. 1, with the same alternative means that is shown in FIG. 7 for securing the detachable loop seizing point to the annular frame or the rotary loop taker, with the addition of a needle and its associated thread shown in full line just before the rotary loop taker takes a loop of thread off the needle, and with successive relative positions of the loop of needle thread with respect to the rotating loop taker shown in phantom.
Figures 9, 10, 11, 11A, 12:
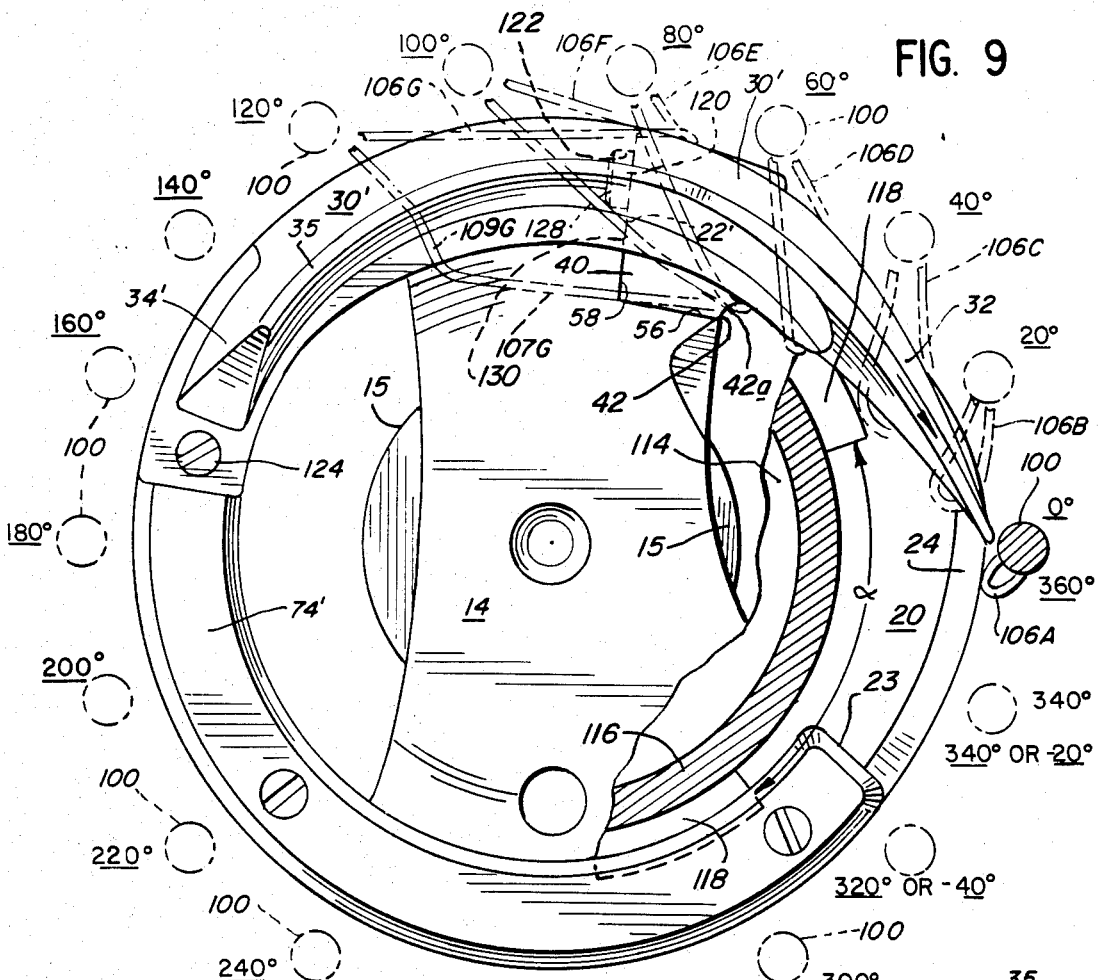
FIG. 9 is a top plan view of the rotary loop taker of FIG. 7, with the addition of a showing of successive relative positions of the needle and the loop of thread with respect to the rotating loop taker, the first position shown in full line and the successive positions shown in phantom.
FIG. 10 is a top plan view of another embodiment of the detachable loop seizing point of this invention.
FIG. 11 is a bottom plan view of an alternative form of the detachable loop seizing point of FIG. 10.
FIG. 12 is a cross sectional view of the loop seizing point of FIG. 10, taken along the line 12—12 of the latter FIG., including a modified mode of attachment of the loop seizing point to the annular frame of the rotary loop taker.
FIG. 11A is a cross sectional view of the loop seizing point of FIG. 11, taken along the line 11A—11A of the latter FIG.

During operation of the drop feed sewing machine, needle 100 remains fixed in horizontal location but moves up and down in vertically reciprocating motion as it penetrates and withdraws from the material being sewn. Although needle 100 does not actually move horizontally, for clarity it is shown in FIGS. 7 through 9 as if it is moving constructively, or in other words relatively, with respect to rotating loop taker 10'. In these Figures rotary loop taker 10' is shown as if it were stationary, with needle 100 occupying successive positions around the loop taker, first for a short distance from right to left (in the embodiment shown, from −40° to 0°) and then from left to right. The fact is, of course, that the needle is completely stationary in horizontal location and it is the loop taker that rotates—in FIG. 7, in a direction to move forward end 32 of loop seizing point 30' from right to left and then to enter the plane of the paper and circle away from the viewer. In FIGS. 8 and 9, rotary loop taker 10' is again shown as if it were stationary, with the direction of actual rotation of rotary loop taker 10' in relation to the solid line position of needle 100 being clockwise.

The position of needle 100 as shown in solid line in FIG. 7 is considered the 0° position, which is just before needle thread loop 106 is engaged by rotating loop seizing point 30'. During operation of the sewing machine, needle 100 does actually move vertically from its lowest position at −40° and up through −20°, 0°, 20°, and so forth around a circle in terms of relative motion with respect to rotary loop taker 10'. The successive vertical positions actually occupied by needle 100 are shown in phantom in FIG. 7 from the −40° position through the 120° position. Later actual vertical positions of the needle with respect to the rotating loop taker are omitted for clarity. Needle 100 rises in its actual vertical movement until it reaches its highest point at about 320°, or in other words at about −40° in relation to its next constructive revolution.

During the second constructive revolution of needle 100 in terms of relative motion with respect to rotary loop taker 10', the needle moves downward until it reaches the 320° position, or the −40° position with respect to the third revolution. At this point, it is again at its lowest point in its actual vertical reciprocating motion.

The successive positions of needle thread loop 106 are shown—starting with loop 106A drawn in solid line in the 0° position and loops 106B and following drawn in phantom in the 20° and succeeding positions in FIGS. 7 through 9, and drawn in solid line in FIGS. 13 through 18—as the loop is picked up by loop seizing point 30' and carried around through approximately one revolution of the rotary loop taker.

The successive positions of aperture 110 in throat plate 108 in relation to loop taker 10' as the latter rotates are also shown in FIG. 7 in phantom, adjacent the respective positions of needle 100 with which the aperture is associated. A fragmentary showing of feed dog 112, which has a saw tooth surface to engage the material being sewed, is also included in FIG. 8.

Growth And Contraction Of Needle Thread Loop

The take-up device of the sewing machine, which is located above the bobbin case and throat plate 108, plays a central part—together with its associated tension assembly—in the production of needle thread loop 106. The take-up device is shown schematically in FIG. 8, but its connection with needle thread loop 106A, for example, is indicated at upper thread segment 105A. Thread segment 105A passes through the take-up device, and extends from there through the associated tension assembly to the spool of needle thread elsewhere on or near the machine. The other end 105B of thread loop 106A is shown extending along feed dog 112 and above throat plate 108.

While rotary loop taker 10' is rotating with respect to needle 100 and the needle is reciprocating vertically, as described just above, the take-up device and its associated tension assembly are adjusted to permit needle thread to pay out during the first half revolution of the rotary loop taker in order to permit loop 106 to grow in size as the motion of the rotary loop taker pulls additional thread through needle eye 104, thus producing a needle thread loop of expanding size. Thereafter, during the second half of the revolution of rotary loop taker 10', the take-up device is adjusted to take up needle thread, to cause loop 106 to become smaller until the rotary loop taker reaches a point at which the loop can be pulled off the free end of the loop seizing point.

This action of the rotary loop taker and the take-up device and its associated tension assembly which results in loop 106 first growing larger and then being reduced in size is best seen in FIGS. 13 through 18. As seen there, loop 106 grows in size from the time it is taken up by rotary loop seizing point 30' until just before rotating loop taker 10' and needle 100 are in about their 240° relative position, and then the loop contracts as that relative position changes to about 360°. In the embodiment shown, as needle 100 moves up and down during the second revolution of rotary loop taker 10', needle thread loop 106 is pulled up by the take-up device and its associated tension assembly, to tighten the loop around the bobbin thread and secure the resulting lockstitch against the material being sewed.

Successive Shapes Assumed By Needle Thread Loop

Loop 106 B, shown in elevation, perspective and plan in FIGS. 7 through 9, respectively, is the approximate shape of the needle thread loop as forward end 32 of loop seizing point 30' takes it off needle 100 at about the 20° position, and loop 106C has been made somewhat larger by the rise of needle 100 and the advance of rotating loop taker 10'. Ordinarily the needle thread loop remains fairly loose around loop seizing point 30' for this first part of the advance of the rotary loop taker.

When the loop taker has advanced far enough that needle 100 is in about the 60° position as shown in the Figures under discussion, loop 106D has been drawn fairly taut against loop seizing point 30', although the take-up device and its associated tension assembly, as discussed above, permit the paying out of needle thread as required during this portion of the rotation of the loop taker. As indicated in the drawings, when rotary loop taker 10' has rotated far enough that needle 100 is in the 80°, 100°, and 120° positions, thread loops 106E, 106F and 106G are pulled quite taut against smoothly curved junction 42 of inwardly extending foot 40.

As will be noted from FIG. 7, after needle eye 104 has been retracted above throat plate 108, the two upper segments of needle thread loop 106 take positions at their top ends that are determined by the size and relative position of aperture 110 with respect to rotating loop seizing point 30'.

In FIGS. 13 through 18, the successive shapes taken by needle thread loop 106 after it has been taken off needle 100 are shown in plan for almost the full 360° of rotation of rotary loop taker 10'. Forward end 32 of loop seizing point 30' is shown in FIG. 13 as it is just ready to take loop 106A off needle 100, and successive positions of the rotating loop taker are shown in FIGS. 14 through 18. Loops 106A, 106D and 106G are shown in plan view in FIGS. 13 through 15 in the respective positions that they occupy as shown in FIG. 7 in elevation and in FIG. 8 in perspective. Needle thread loops 106J, 106M and 106P are shown in plan view in FIGS. 16 through 18 in the positions they occupy as loop taker 10' rotates still farther with respect to needle 100.

Sliding of Thread In Longitudinal and Transverse Directions Along And Across Tapered Forward End of Loop Seizing Point As shown in FIGS. 7 through 9 and 13 through 18, as the needle thread loop grows and diminishes in size as just described, the thread loop slides all the while in the longitudinal direction along tapered forward end 32 of loop seizing point 30 or 30' from the tip **32*b* of member 32 to base portion 32*a* and back again, until it is pulled off member 32 (just after the position it occupies in FIG. 18**) by the take-up device.

As will be seen from FIGS. 7 through 9 and 13 through 18, needle thread loop 106 in its various configurations is held quite taut (somewhat less so in the last half of the rotation of the loop taker) by the opposing forces of rotating loop seizing point 30' and the take-up device and its associated tension assembly, which are located above the rotary loop taker. As a result of this continuing tension on the needle thread loop—which holds the loop in taut engagement with the loop seizing point during the first half of one revolution of the loop taker, and in what may be called snug engagement during the last half—it will be seen that when the loop grows and diminishes in size as described, in addition to sliding in the longitudinal direction along tapered forward end 32 of loop seizing point 30 or 30', the thread also necessarily slides in the transverse direction across the tapered forward end, along the longitudinal axis of the thread.

As seen in FIG. 8, free end 105B of needle thread loop 106A lies above feed dog 112, anchored against the material being sewed by the bobbin thread that has been pulled tight against the needle thread to produce the previously formed lock stitches across the material. In this condition, end 105B obviously can not move. Thus it is thread segment 105A that must move down through needle aperture 110 as thread "pays out" from the needle thread spool in response to the pulling action exerted by rotating loop seizing point 30 or 30' as the loop taker rotates. Examination of FIG. 8 makes it clear that as the needle thread is thus paid out to form loops of increasing size, the thread must slide along its length across the loop seizing point. If it did not do so, the needle thread loop would be broken by the force applied to it by the loop seizing point.

The converse is also true. When the needle thread loop is drawn snug against the loop seizing point in the last half of the rotation of the loop taker, and the take-up device and its associated tension assembly pull the needle thread into loops of diminishing size, the thread must slide along its length across the loop seizing point. If it did not do so, it would not remain snug against the loop seizing point, but would instead flop around loosely and very likely get caught on some protuberance or other in the sewing machine and be broken.

The sliding of the thread in a needle thread loop along its length across the loop seizing point is, of course, movement in the transverse direction with respect to tapered forward end 32 of the loop seizing point.

Passing Of Loop Around Bobbin Case

The objective of the forming and circling of the needle thread loop as so far described is to cast a loop of needle thread around the bobbin thread so as to form a lock-stitch as the material is sewed, with the needle thread disposed in the final stitch along one side of the material and the bobbin thread disposed along the other side. This is accomplished by causing needle thread loop 106 to pass around the bobbin case as it is carried around by rotary loop taker 10'.

As will be seen from the position of needle thread loop 106G in FIGS. 7, 8 and 15 and the position of loops 106J and 106M in FIGS. 16 and 17, respectively, one segment of the advancing needle thread loop passes over loop seizing point 30' while another segment, indicated at 107, passes under the loop seizing point and also under the bobbin case around which the loop taker rotates. To help illustrate this, FIGS. 7, 9 and 13 through 18 contain fragmentary showings of the bobbin case, including a portion of bottom wall 114 and outer cylindrical or side wall 116 (the latter shown in section of FIGS. 9 and 13 through 18).

Fragmentary portions of radially extending rib 118 carried by side wall 116 of the bobbin case are also shown in FIGS. 7 and 13 through 18. Rib 118, which fits loosely into raceway 70 in the inner wall of rotary loop taker 10', maintains the position of the bobbin case axially of loop taker 10' as the latter rotates about the stationary bobbin case 114/116 and past horizontally stationary needle 100. The angular position of the bobbin case is maintained by a stop (not shown) of a conventional type known to those skilled in the art.

As will be seen in FIGS. 9 and 13 through 18, there is a gap in rib 118 adjacent needle 100. This gap, indicated by the angle $\alpha$ in FIGS. 9 and 13, may be approximately 70 degrees, 80 degrees, or the like. The major portion of the gap usually lies in front of needle 100, or below the needle as shown in FIGS. 9 and 13 through 18 for the embodiment illustrated. It is through this gap $\alpha$ in rib 118 that segment 107 of loop 106 is permitted to pass beneath the bobbin case as loop seizing point 30' carries the loop around through one revolution.

Thus, FIGS. 15 through 17 show how bottom segments 107G, 107J and 107M, respectively, pass under bottom wall 114 of the bobbin case through the gap in radially extending rib 118. Specifically, as indicated in FIGS. 8 and 15, bottom segment 107G of loop 106G passes at 109G around the bottom wall 114 and side wall 116 of the bobbin case, and from there to needle 100. In a similar way, bottom segment 107J of loop 106J passes under the bobbin case and at 109J upwards towards needle 100. Needle thread loop 106M does the same at 109M.

Critical Importance Of Smoothly Curved Junction Between Lug And Inwardly Extending Foot From this explanation of the manner in which loop seizing point 30 or 30' takes a needle thread loop 106 off needle 100 and carries it around the bobbin case, it is seen that the smoothly curved junction 42 without any seams or joints that is formed by downwardly extending support lug 36, the base portion of tapered forward end 32 of loop seizing point 30, and inwardly extending foot 40 is of critical importance.

As is best seen in FIGS. 7 and 8, when the needle loop threads are pulled taut against smoothly curved junction 42, they will be able to slide freely across that junction not only laterally but also along their length as further rotation of the rotary loop taker pulls more thread from the needle thread spool located above the throat plate. FIGS. 7, 8 and 14 through 18 show how smoothly curved junction 42 is embraced by the taut needle thread loop at the most rearward point **42*a* in its sliding movement along the tapered forward end 32 of loop seizing point 30 or 30' from the forward end portion 32*b* to base portion 32*a*** and back again. If the loop of needle thread is caught in any crevice or crack along the path followed by the the thread as the loop taker rotates, snagging of the thread will break it and will sometimes cause jamming of the machine.

None of the prior art rotary loop takers having detachable loop seizing points recognized, so far as applicant is aware, the critical importance not only of providing smoothly formed surfaces throughout the length of the loop seizing point but, specifically, a smoothly curved surface at this particular location on the loop seizing point. It is for this reason, among others, that the invention disclosed in the patent to Grabowski, for example, which is discussed above, has not been satisfactory.

The several vertically laminated detachable loop seizing points referred to above that have been disclosed in the prior art will also be seen to be defective because there are a number of cracks and crevices in those loop seizing points where there is a danger that the needle thread loop will be snagged or caught. This is in addition to the basic defect that laminated loop seizing points suffer because of their type of construction in not providing the same strength and stability that is achieved by the thick, sturdy integrally formed mass of the loop seizing point of this invention.

Initial Portion Of Bobbin Case Raceway Defined By Detachable Loop Seizing Point As already pointed out above, the bobbin case with which the rotary loop taker of this invention is used is maintained in a substantially fixed position in the sewing machine. The bobbin case may be a conventional, generally cylindrical bobbin case, as discussed above, whose side wall 116 carries rib 118 extending radially from its vertical midsection for guiding the loop taker as the latter rotates about the bobbin case.

The complementary structure in the rotary loop taker of this invention is raceway 70 or 70' (best seen in FIGS. 1 and 8) that extends around inner wall 66 of circular frame 12 or 12' respectively. Lower part 68 of middle and final portions of bobbin case raceway 70 or 70' is defined by lower ledge 72 carried by inner wall 66 of circular frame 12 or 12'.

Semicircular gib 74 or 74' is detachably secured to the top of frame 12 or 12' (FIGS. 1–3 and 7–9, respectively). The gib defines upper part 76 or 76', respectively, of middle and final portions of raceway 70 or 70'. Vertical wall 73 of raceway 70 and 70' is formed in inner wall 66, in the middle and final portions of the raceway, between lower ledge 72 at the bottom of the raceway and upper ledges 84 or 84' and 76 or 76' at the top.

An important feature of the rotary loop taker of this invention (best seen in FIGS. 1 and 6 for one embodiment and 7 and 12 for the second embodiment) is the provision of an initial portion of bobbin case raceway 70 or 70' which is defined by ledges formed in detachable loop seizing point 30. When the raceway in a rotary loop taker suffers wear or other damage during use, this tends to restrict the free passage of the thread around the bobbin case, and thread breakages and other undesirable consequences discussed below frequently result. When such damage occurs to the bobbin case raceway, the conventional integrally formed loop taker must be totally replaced.

As pointed out above, one troublesome condition that results from wearing of the bobbin case raceway in the rotary loop taker is known in the industry as "slop." In this condition, the raceway becomes so worn that there is too much "play" between the outwardly extending bearing rib of the bobbin case and the raceway. As a result, the bobbin case "wobbles" within the rotary loop taker as the latter rides around it, and this causes interference with the proper release of the needle thread from around the bobbin case. This loose seating of the bobbin case within the rotary loop taker that constitutes the condition of "slop" also increases the incidence of jamming between the bobbin case and the raceway.

In the loop seizing point of the rotary loop taker of this invention, initial portion 80 of bobbin case raceway 70 or 70' is defined by lower ledge 82 and upper ledge 84 or 84', respectively—with vertical wall 85 lying between those lower and upper ledges—all of which are formed in the inner wall of detachable loop seizing point 30 or 30' (FIGS. 1, 6, 8 and 12). Upper ledge 84 or 84' on the inner wall of loop seizing point 30 or 30' defines the upper part of an initial portion of bobbin case raceway 70 or 70', respectively, preferably the entire initial portion. Lower ledge 82 defines the lower part of an initial portion of bobbin case raceway 70 or 70', and preferably the entire initial portion of the raceway. It has been unexpectedly found that replacing only the initial portion of a raceway that has been damaged throughout its entire length corrects the "slop" that is otherwise present, and makes the rotary loop taker usable again.

The absence of any such ledges in the inner wall of the loop seizing point to define the initial portion of the bobbin case raceway is another critical reason that the Dickson device and other prior art detachable loop seizing points referred to above were unsatisfactory or totally inoperable.

As best seen in FIGS. 6 and 12, the top boundary of rearwardly facing surfaces 37 and 130 of downwardly extending supporting lug 36 or 36' is located in a plane that lies substantially at the level of the bottom surface of said upper ledge 84 or 84', respectively. This feature results in a more secure and firm attachment of the loop seizing point to the frame or base of the rotary loop taker, and unexpectedly this is achieved without any undesirable results from the interruption of lower ledge 82 and vertical wall 85 in the important initial portion 80 of the bobbin case raceway.

As seen from FIG. 1, the bottom surface of upper ledge 84 lies in substantially the same plane throughout the entire extent of the ledge. FIG. 8 shows that the same is true of upper ledge 84' in the embodiment of that Figure.

Beveling Of Vertical Walls In Bobbin Case Raceway

As seen from FIG. 1, the end of the vertical wall of initial portion 80 of bobbin case raceway 70 defined by loop seizing point 30 that lies at the trailing end of lower ledge 82 during forward rotation of annular frame 12 is beveled at 81. Likewise, the end of the inner wall of frame 12 that helps to define the middle portion of raceway 70 and lies at the trailing end of cut-away portion 20 of frame 12 during forward rotation thereof may be beveled at 83.

Bevel 81 does two things. First, it provides a gradual transition between the trailing end of the initial, shallower portion 80 of raceway 70 in a newly installed, unworn, replacement loop seizing point 30 on the one hand, and the deeper middle portion of raceway 70 in annular frame 12 on the other, when that middle portion has been worn away by previous use of the rotary loop taker with the original loop seizing point or with a previously installed replacement loop seizing point. Second, it avoids any sharp edge that would interfere with reversing the direction of angular movement of the rotary loop taker during any reversal of the sewing machine, whenever the vertical walls of bobbin case raceway 70 defined by frame 20 and by detachable loop seizing point 30 do not line up because of a greater degree of wear in the former as just referred to.

Bevel 83 will avoid any sharp edges that could protrude into raceway 70 if the initial portion and middle portion of the raceway in a newly manufactured rotary loop taker are both within manufacturing tolerances but the initial portion of the raceway (defined by the inner wall of the loop seizing point) happens to be deeper than the middle portion of the raceway (defined by the inner wall of the annular frame).

Means For Securing Loop Seizing Point

In the embodiment of this invention shown in FIGS. 1 through 6, loop seizing point 30 is detachably secured to annular frame 12 by means of screws 89 (shown in cross section in FIG. 5) that are inserted through screw-receiving holes 90 in circular frame 12 and screwed into threaded holes 92 in rear portion 34 of loop seizing point 30 (FIGS. 3 and 5). In the embodiment shown, a plurality of stud means 94 is mounted on frame 12, with complementary holes 96 located in rear portion 34 of loop seizing point 30.

Studs 94 and holes 96 can be machined to closer tolerances than threaded screws and threaded holes, which helps assure a good fit for loop seizing point 30 on annular frame 12. The use of two studs 94 provides a rigid attachment of loop seizing point 30 to frame 12, insuring proper positioning of the loop seizing point at all times by reliably and automatically achieving accurate alignment of the loop seizing point upon the frame.

Second Embodiment Of Securing Means

In the embodiment of this invention shown in FIGS. 7 through 18, loop seizing point 30' is detachably secured to annular frame 12' by the cooperative action of positioning and retaining post 120, complementary cavity 122, releasable anchoring means in the form of screw 124, and aperture 126 for receiving means 124 (best seen in FIGS. 8 through 12). Post 120, preferably with beveled edge 128 at its free end, is carried by rear wall 130 of downwardly extending supporting lug 36'. Complementary cavity 122 is located in end wall 22' of frame 12, which is at the trailing end of cut-away portion 20 during rotation of the frame (FIG. 9).

Post 120 and complementary cavity 122 can if desired be interchanged, with the post carried by frame end wall 22' at the trailing end of cut-away portion 20 of the frame as the frame rotates and the complementary cavity located in downwardly extending supporting lug 36 of loop seizing point 30'. Reversing the post and cavity to position them on the frame end wall and downwardly extending supporting lug, respectively, will simplify fabrication of the detachable loop seizing point, but complicate the replacement problem if the post carried by the end wall of the annular frame is broken off or otherwise seriously damaged.

Rear portion 34' of loop seizing point 30' is releasably anchored to frame 12' by releasable anchoring means or screw 124 that passes through aperture 126 and is threadably received in frame 12'. In this embodiment, upper ledge 76' of raceway 70 that is provided by gib 74' is shorter in length than upper ledge 76 of gib 74 in the embodiment of FIGS. 1 through 6.

As shown in particular by FIGS. 9 through 12, when screw 124 has been removed, this permits circumferential movement of loop seizing point 30', without any radial movement of the same, with respect to the annular frame of the loop seizing point. This circumferential movement (1) clears post 120 from complementary cavity 122, and (2) through said clearance, permits an inward tilting of top 35 of the loop seizing point and an outward tilting of the bottom of the loop seizing point to clear the loop seizing point both of the bobbin case and of the surrounding parts of the sewing machine for removal of the loop seizing point from its annular frame.

In both securing means just described, it is important that no part of the means for detachably securing loop seizing point 30 or 30' to annular frame 12 or 12' respectively, is located forward of downwardly extending supporting lug 36 or 36'. Put another way, the securing means is located entirely rearward of tapered forward end 32 of the loop seizing point. This means that the detachable securing means does not interfere in any way with tapered forward end 32 of the loop seizing point as it takes needle thread loop 106 off needle 100 and moves the loop around rotary loop taker 10 and the bobbin case.

FIGS. 11 and 11A illustrate a modification of or improvement on the second embodiment of the releasable securing means on the rotary loop taker of this invention. In this improvement, circumferentially oriented elongated slot 140 is provided at the end of rear portion 34' of loop seizing point 30'. In the embodiment shown, slot 140 is open at its remote end 142.

Screw means 144 (FIG. 11A) has a cylindrical shank portion 146 adjacent the head of the screw, and narrower threaded portion 148 at its free end. Shank portion 146 forms a close fit with the walls of elongated slot 140.

As a result of this construction, the radial positioning of rear end 34'—and therefore of tapered forward end 32 of loop seizing point 30'—can be controlled by the position of slot 140. At the same time, the circumferential positioning of tapered forward end 32 and its tip 32*b* can be accurately, easily and conveniently established by inserting post 120 in cavity 122 and bringing rearwardly facing surface 130 of lug 36 into abutment with forwardly facing end wall 22' of frame 12'.

Advantages of Securing Means

Both the first and second embodiments of the detachable securing means described permit initial separation of loop seizing point 30 or 30' from annular frame 12 or 12' without any movement in a radial direction with respect to the annular frame, which then makes possible the final removal of the loop seizing point by tilting of that member in the manner described above. This feature is valuable because of the very cramped spaces around the rotary loop taker in conventional commercial sewing machines, which make it important that when the loop seizing point is to be replaced it can be done with a minimum of movement before it is lifted out of its position on the annular frame.

This feature, standing alone, is useful with the embodiment of applicant's invention shown in FIGS. 1–6, if that embodiment is incorporated in a special type of industrial sewing machine that in the United States represents about 5 to 10 percent of the industrial sewing machines having vertical shaft rotary loop takers (i.e., about 2 to 4 percent of all industrial sewing machines). These machines are of an older type of construction (which does not have a prohibitive number of interfering parts) such that the machine head can be tipped back to permit the operator to use a screwdriver or other suitable tool to reach into the exposed bottom of the sewing machine. As will be seen, with sewing machines of this type, removing screws 89 of the securing means of the embodiment of FIGS. 1–6 will make it possible to separate loop seizing point 30 from its annular frame 12—after the throat plate has been loosened and the bobbin case has been rotated into a position to provide clearance for the lower ledge of the initial portion of the raceway in the loop seizing point—without any movement of the loop seizing point or screws 89 in a radial direction with respect to the frame.

Removing the loop seizing point and replacing it with a new loop seizing point in this manner will, as just explained, require a special tipping maneuver followed by reaching within the exposed bottom of the machine, which will unavoidably cause some amount (in some cases, a very large amount) of inconvenience. However, it will not require either (1) dismantling the sewing machine to remove the rotary loop taker annular frame or base, or (2) re-timing the machine after the frame or base is thus removed. As a result, in this 5 to 10 percent of industrial sewing machines having vertical shaft rotary loop takers, the loop seizing point can be removed and replaced with a new loop seizing point with considerably less "down time" than is incurred when an entire conventional, integrally formed rotary loop taker, including the annular frame or base, has to be removed in order to replace its damaged loop seizing point.

An additional advantage provided by the second embodiment of the detachable securing means described is this: Anchoring means 124, which must be released before loop seizing point 30' can be removed, is located in an exposed position accessible to an operator from outside the sewing machine, without having to remove any other part of rotary loop taker 10' the bobbin case, or any other part of the machine, in every type of industrial sewing machine, whether the rotary loop taker of the machine is of the horizontal shaft or vertical shaft type. This fact avoids the inconvenience of the tipping maneuver and working on the bottom of the sewing machine that is described just above, and extends to industrial sewing machines of all types known to applicant the full savings in down time that follows from the ability to replace a loop seizing point without removing either the bobbin case, the annular frame of the rotary loop taker, the shaft of the rotary loop taker, or any other part of the sewing machine (except for screw 124 or similar anchoring means). This is a far simpler and more convenient construction than is disclosed in the prior art for other detachable loop seizing points.

Another important advantage of both the first and second embodiments of the detachable securing means of the rotary loop taker of this invention is that each of them provides accurate alignment of the loop seizing point on the substantially annular frame of the rotary loop taker, and does so with a minimum manufacturing cost for the device. Both embodiments of the securing means disclosed employ one or two aligning studs and cooperating screw means, with the number of abutting surfaces on the loop seizing point itself and on the remainder of the rotary loop taker sharply restricted.

Accurate vertical and circumferential alignment of the loop seizing point is provided in both embodiments of the detachable securing means by controlling the accuracy of only two pairs of abutting surfaces. When a downwardly extending support lug nested in a notch in a crosswise extending frame support member is included in the device of this invention, one need control the accuracy of only one additional pair of vertical abutting surfaces for radial alignment of the loop seizing point.

In the embodiment of FIGS. 1–6, substantially annular frame 12 has an upwardly facing top surface 150 extending rearwardly from frame end wall 22 that is at the trailing end of cut-away portion 20 during forward rotation of the frame. Loop seizing point 30 has a downwardly facing surface 152 on the bottom of rear portion 34. Both surfaces 150 and 152 are planar, and are carefully fabricated so that as they abut each other when loop seizing point 30 is installed on frame 12, they initiate an accurate vertical alignment of loop seizing point 30, and therefore of tapered forward portion 32 and tip **32*b*. Loop seizing point 30** and the remainder of the rotary loop taker are substantially free of any other abutting surfaces, except for any surfaces on the detachable securing means itself, that affect the vertical alignment of the loop seizing point.

Circumferential alignment of loop seizing point 30 and its tapered forward end 32 is initiated by abutment of planar surface 37 with planar surface 22 and 58, and radial alignment by abutment of planar surface 44 with planar surface 56. When loop seizing point 30 is installed in place on substantially annular frame 12, rearwardly facing surface 37 of downwardly extending supporting lug 36 abuts the forwardly facing surface of frame end wall 22 and radially oriented wall 58 of notch 54, and inwardly facing surface 44 of lug foot 40 abuts outwardly facing surface 56 of edge portion 50 of support member 14. Loop seizing point 30 and the remainder of the rotary loop taker are substantially free of any other abutting surfaces, except for any surfaces on the detachable securing means itself, that affect the horizontal alignment of loop seizing point 30 on frame 12 in either the radial or circumferential direction.

It will be seen that for vertical, circumferential, and radial alignment, respectively, of the loop seizing point there is in each instance only one pair of abutting surfaces that must be accurately fabricated. This minimizes significantly both the difficulty and the cost of manufacturing the detachable loop seizing point of this invention and its frame or base.

Vertical and horizontal alignment of loop seizing point 30 is completed by the use of studs 94 on frame 12 and holes 96 in rear portion 34 of loop seizing point 30, in cooperation with screw means 89, as explained above.

In the second embodiment of the detachable securing means for the loop seizing point, frame 12' has an upwardly facing surface 154 extending rearwardly from frame end wall 22. Rear portion 34' of loop seizing point 30' has a downwardly facing surface 156 that abuts upwardly facing surface 154 on annular frame 12' to initiate accurate vertical alignment of loop seizing point 30' (See FIGS. 7 and 11.) Again loop seizing point 30' and the remainder of the rotary loop taker are free of any other abutting surfaces, except for any surfaces on the detachable securing means itself, that have any horizontal component that affects the vertical alignment of the loop seizing point.

Circumferential alignment is initiated by the abutment of rearwardly facing surface 130 of downwardly extending supporting lug 36' and, as before, the forwardly facing surfaces of end wall 22' and wall 58 of notch 54, with radial alignment initiated by abutment of surfaces 44 and 56. Loop seizing point 30' and the remainder of the rotary loop taker are free of any other abutting surfaces, except for any surfaces on the detachable securing means itself, that have any vertical component that affects the horizontal alignment of the loop seizing point on the frame in either the radial or circumferential direction.

Accurate, quick and convenient vertical and horizontal alignment of loop seizing point 30' on annular frame 12' is completed by inserting post 120 in cavity 122, and inserting screw means 124 in aperture 126, as explained above.

In both the embodiments described, the screw means that cooperates with the aligning stud or studs is spaced circumferentially from the stud or studs, as will be seen from the Figures of the drawing.

Separate Sale Of Loop Seizing Points As Replacement Parts

As pointed out above, one of the principal advantages of the present invention is that when loop seizing point 30 or 30' becomes worn, chipped, broken or damaged in any other way—either in tapered forward end 32, the initial portion of raceway 80, or otherwise—the loop seizing point can be removed and replaced without removing any other part of the rotary loop taker. Thus, the sale of new loop seizing points as replacement parts for damaged elements in the rotary loop taker of this invention that was first sold as original equipment will be an important part of any business in which this important invention is practiced.

For the reason indicated, a group of subcombination claims is included in this application to cover the invention of the loop seizing point separately from the remainder of the rotary loop taker.

Applicant's Novel Solution To Critical Shortcomings Of Prior Replaceable Loop Seizing Points As explained above, the preferred form of applicant's invention includes, in combination, the following four essential features:

1. Nesting of the downwardly extending supporting lug of the loop seizing point within a notch formed by the rotary loop taker annular frame and its crosswise extending support member;

2. The provision of a foot extending inwardly from the lower portion of the downwardly extending supporting lug, with a smoothly curved junction formed by the lug, the lug foot, and the base portion of the tapered forward end of the loop seizing point;

3. Cutting through the initial portion of the bobbin case raceway to extend the rearwardly facing surface of the downwardly extending supporting lug up to the bottom surface of the upper ledge of the raceway; and 4. Using one or more aligning studs and cooperating screw means, with sharp restriction of the number of abutting surfaces on the annular frame of the rotary loop taker and on the loop seizing point itself, to provide accurate vertical and horizontal alignment of the loop seizing point in relation to the annular frame.

Each of these four novel features has contributed to applicant's success in constructing a replaceable loop seizing point that solves the long standing, widely recognized, and urgent problem of loop seizing point wear and damage—with accompanying loss of production time and cost of replacement parts—that is discussed above in this application.

Specifically, each of these four features has helped make it possible, almost 60 years after the Dickson patent was issued, to provide a replaceable loop seizing point that overcomes the three critical problems discussed below that have made prior attempts to construct a replaceable loop seizing point wholly unsuccessful.

A. Firm And Secure Attachment Of Loop Seizing Point To Annular Frame

For two reasons, the problem of effecting a firm and secure attachment of a replaceable loop seizing point to its annular frame or base in a rotary loop taker for a lock-stitch sewing machine is a critical and difficult problem:

1. The magnitude of the distorting and destructive forces to which a loop seizing point is subjected during use is shown, for example, by the fact that the point not only often becomes burred or chipped, but it may even be broken off completely at its tip. Indeed, forces of such very high magnitude would be expected simply from the high speeds at which loop takers are rotated in a lock-stitch sewing machine—as high as 4,000 to 10,000 r.p.m. (or even higher) for a needle feed machine or a drop feed machine, and about 6,000 to 8,000 r.p.m. for a walking foot machine. Daily experience throughout the industry confirms this expectation.

In particular, it frequently happens that forces of very considerable size are applied against the loop seizing point in horizontal directions A, B or C as shown in FIG. 23, when the rapidly rotating loop seizing point accidentally strikes the needle of the machine as a loop of thread is taken off the needle by the loop seizing point. Forces off equally great size directed vertically upward (represented by arrow D in FIG. 23) are applied to the loop seizing point if, as happens from time to time, extreme thread build-up below the bobbin case pushes the bobbin case upward and thus pushes its outwardly extending rib against the upper ledge of the bobbin case raceway.

These and other forces applied to the loop seizing point must be opposed by a highly secure and firm positioning of the point on the frame or base of the rotary loop taker, or the point will be forced out of its proper alignment and cause great damage to the tip of the point, to the needle, to the bobbin case raceway, to the bobbin case itself, and to still other parts of the sewing machine.

B. Avoidance Of Snagging Of Thread

The critical importance of avoiding any construction of a replaceable loop seizing point that may cause the snagging and breaking of the needle thread is clear beyond any question.

The production of defective seams in the material being sewed and the loss of productive machine operating time while the machine is being re-threaded to return it to operating condition, both of which occur every time a thread is broken, are reasons enough why it is essential to do whatever is possible to avoid letting the needle thread get snagged or broken.

In addition, in perhaps ten percent of the cases in which the needle thread is broken, the break produces a condition known as "threadlock," which keeps the loop taker from rotating and requires the machine mechanic to shut the machine down altogether to correct the condition.

C. Quick, Accurate Alignment Of Loop Seizing Point With Minimum Manufacturing Cost The necessity of maintaining the loop seizing point accurately aligned upon the substantially annular frame of the rotary loop taker is mentioned above. Without such alignment, at worst great damage can be caused in several ways to various parts of the sewing machine, and at the least the machine will not produce high quality sewing.

It is also important to achieve the necessary accurate alignment of the loop seizing point on the loop taker frame quickly and easily during the adjustment of the loop seizing point, the needle, and the needle guard that is carried out by the machine mechanic to ready the sewing machine for use. To achieve the necessary alignment quickly and conveniently, as the present invention does, saves the time of the mechanic and therefore holds down operating costs and boosts the output of the machine.

Holding down the cost of manufacturing the rotary loop taker and its replaceable loop seizing point is also of importance. If the cost of fabricating the device can be materially reduced and economies of cost can thus be passed on to purchasers, the owners of industrial sewing machine installations who are interested in the production cost savings that can be achieved by the use of replaceable loop seizing points will be still more likely to purchase and use such a device in view of the pricing level.

Prior Unsuccessful Attempts To Meet Strength, Snagging, And Alignment Problems

Anyone who is familiar with the operation of a lockstitch sewing machine is aware of the necessity of keeping the loop seizing point held firm—against extremely strong distorting forces—in its proper position as established by the machine mechanic in his initial adjustment of the rotary loop taker, the needle and the needle guard.

Any skilled worker is also fully aware of the need to do whatever is possible to avoid any snagging of the needle thread, and the undesirable consequences that result when any such snagging does occur.

The great advantage to being able to achieve the initial alignment of the loop seizing point quickly and easily will also be clear to any skilled worker.

Finally, any such person will necessarily also be aware of the magnitude of the ever present problem of wear on, and damage to, the loop seizing point of the rotary loop taker.

Because of this universal awareness, skilled workers in this field have over the years attempted a variety of approaches to the problem of developing a rotary loop taker with a loop seizing point that is not only replaceable but is firmly and securely enough attached to its base, and is satisfactory enough in all other respects, that it can compete with integrally formed rotary loop takers of the conventional, accepted types. Some of these attempts have involved replaceable loop seizing points of vertically laminated construction, and others have not.

Despite these continuing efforts by persons skilled in the art to develop a successful replaceable loop seizing point, until applicant's invention was made, it was not found possible to construct such a point that provided the necessary attachment strength and avoidance of snagging, as well as the other characteristics that are required to make the device commercially satisfactory.

Applicant's Solution

Applicant has solved the problem of strong and secure attachment of a replaceable loop seizing point to the annular frame or base of a rotary loop taker, while maintaining the other necessary characteristics of the loop taker, by expedients never before attempted, or even hinted, in the prior art.

The first feature of the rotary loop taker of the present invention that is listed above—the nesting of the lower portion of the downwardly extending supporting lug against the two intersecting walls of the notch formed by the annular frame and its crosswise extending support member—places the mass of the downwardly extending support lug firmly against both the forwardly facing frame end wall and the circumferentially oriented notch wall. This produces a strong basic attachment of the loop seizing point to the substantially annular frame of the rotary loop taker, to oppose the large distorting forces to which the seizing point is subjected in use.

The second feature listed above—the inwardly extending lug foot—produces a still more secure attachment in the following two ways:

By widening the bottom portion of the downwardly extending supporting lug for the loop seizing point, it makes possible a greater mass of material in the lug, and this in and of itself results in a stronger and more secure attachment of the seizing point to the base.

Likewise, the larger abutment area at the rear surface of the lug that results from the widening of the bottom portion of the lug produces a more secure attachment of the loop seizing point to the base. In addition to increasing the strength of the attachment of the loop seizing point to the annular frame as explained above, applicant's second feature—the inwardly extending lug foot and its smoothly curved junction with the remainder of the loop seizing point—provides a successful solution to the problem of avoiding the snagging of the needle thread. This is so because (1) the lug foot and the smoothly curved junction formed between the lug, the lug foot, and the base portion of the tapered forward end of the loop seizing point avoid any cracks in the path of the needle thread that would snag the thread and produce thread breakage, (2) the lug foot prevents the taut thread loop from being pulled back during operation of the machine beyond the desired rearwardmost position of the loop, and (3) the lug foot helps avoid the danger present in the device of the Dickson patent that a needle thread loop may fall down slack from said tapered forward end base portion (for example, during reversal or sudden stopping of the sewing machine) and slip partly or entirely under the loop seizing point and annular frame, where it is likely to be snagged in any of several cracks and break or produce the condition known as "thread lock."

The third important feature of the rotary loop taker of this invention—cutting through the initial portion of the bobbin case raceway to extend the rearwardly facing surface of the downwardly extending supporting lug up to the bottom surface of the upper ledge of the raceway—is unexpectedly able to strengthen significantly the attachment of the loop seizing point to its annular frame or base in four additional ways without interfering with the proper functioning of the critical initial portion of the raceway:

By greatly increasing the depth of the lug, it makes possible a greater mass of material in the lug, this producing a still stronger and more secure attachment of the loop seizing point to the annular frame or base of the rotary loop taker.

The increased depth of the lug also increases the abutment area at the rearwardly facing surface of the downwardly extending support lug, which likewise produces a more secure attachment of the loop seizing point to its frame or base.

The increased depth of the lug makes it possible to position a substantial portion of the lug so that it extends upward to the vicinity of the vertical midpoint of the base portion of the tapered forward end of the loop seizing point, which also helps produce a more secure attachment of the loop seizing point to its frame or base.

The larger abutment area at the rearwardly facing surface of the lug makes possible a larger anchoring post (such as post 120 in FIGS. 11 and 12) than could be accommodated with the small abutment area available with the shallow lug that would result from failing to cut through the initial portion of the bobbin case raceway in the manner described.

Finally, the fourth important feature of this invention—using one or more aligning studs and cooperating screw means, with a sharply restricted number of abutting surfaces in the loop seizing point and the remainder of the rotary loop taker—achieves two important advantages:

Quick, convenient, and accurate alignment of the loop seizing point in place in the sewing machine.

Minimum manufacturing cost for the substantially annular frame of the rotary loop taker and the detachable loop seizing point that is installed on the frame, since only one pair of accurately fabricated abutting surfaces on the loop seizing point and the remainder of the rotary loop taker must be provided to produce proper vertical alignment, one pair for circumferential alignment, and one pair for radial alignment.

All the advantages listed are achieved by applicant's novel structure—a novel structure that is nowhere taught or suggested in any prior art known to the applicant.

The above detailed description has been given for ease of understanding only. No unnecessary limitations should be understood therefrom, as modifications will be obvious to those skilled in the art.

I claim:

1. A rotary loop taker for rotation about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, which comprises:

(a) a frame of substantially annular construction, said frame having a cut-away portion along one segment of its circumference to provide space for the needle thread to exit from the loop seizing point of the rotary loop taker as said thread is pulled off the loop seizing point by the take-up device, said cut-away portion being defined by opposing end walls of said frame facing upon said cut-away portion;

(b) a frame support member extending crosswise of said substantially annular frame, with one edge portion of said crosswise extending support member facing said cut-away portion of said frame, said one edge portion of said crosswise extending support member and the one of said frame end walls that is at the trailing end of said cut-away portion during forward rotation of said frame defining a lug-receiving notch, said notch having a first wall that is generally parallel to the circumference of said frame and a second wall that is generally radially positioned with respect to said frame, said notch extending inwardly from the outer circumference of said frame, extending along said frame in an angular direction opposite to the direction of forward rotation of the frame, and extending axially entirely through said crosswise extending support member;

(c) a shaft for said annular frame attached to said frame support member and extending at generally right angles thereto for rotating said frame about said bobbin case in a predetermined plane during operation of said sewing machine;

(d) a detachable loop seizing point mounted on said frame having generally the same curvature as said substantially annular frame, said detachable loop seizing point:

(i) being integrally formed from one end to its other end, (ii) having a single continuously tapered, smoothly shaped, integrally formed forward end, said tapered forward end having its largest transverse dimensions in a base portion and tapering to its smallest transverse dimensions at its free end, (iii) having a supporting lug that extends directly downward into said cut-away portion of said frame from immediately behind said base portion of said tapered forward end, the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the frame, said downwardly extending supporting lug extending into said lug-receiving notch defined by said one edge portion of said crosswise extending support member and said frame end wall, in nesting relationship with said notch, with the inwardly facing surface of said lug abutting at all times substantially the entire outwardly facing surface of said first notch wall, said tapered forward end extending forwardly of said downwardly extending supporting lug into said cut-away portion of said frame, said lug forming a smoothly curved junction with said tapered forward end base portion, said smoothly curved junction being free of any joints or seams; and (iv) having a rear portion extending rearwardly of said lug along said annular frame; and (d) means for detachably securing said loop seizing point to said frame, said means being located entirely rearward of said tapered forward end of said loop seizing point.

2. The rotary loop taker of claim 1 in which:

said lug-receiving notch extends inwardly from the outer circumference of said substantially annular frame towards said shaft to a location that is inward of said frame and within said frame support member edge portion that faces said cut-away portion of said frame, said downwardly extending supporting lug includes a foot that extends from the lower portion thereof, from behind the base portion of said tapered forward end, inwardly towards the center of said annular frame to provide a smoothly curved junction between said lug, said foot, and said tapered forward end base portion, said smoothly curved junction being free of any joints or seams and extending inward beyond said base portion of said tapered forward end; and said lug foot extends inwardly into said lug-receiving notch within said one edge portion of said crosswise extending support member, in nesting relationship with said notch, with the rearwardly facing surface of said lug foot abutting at all times the portion of said second notch wall that is formed by said crosswise extending support member.

3. The rotary loop taker of claim 2 in which said lug foot extends inward from said lug towards the center of said annular frame a distance at least equal to the diameter of the largest thread with which said sewing machine is used.

4. The rotary loop taker of claim 1 in which said detachable loop seizing point has an inner wall and an outer wall, said inner wall carrying an upper ledge that defines the upper part of an initial portion of a raceway to receive said radially extending rib on the side wall of said bobbin case and a lower ledge that defines the lower part of an initial portion of said bobbin case raceway, with a vertical wall for said initial portions of the raceway lying between said upper and lower ledges, the bottom surface of said upper ledge carried by said loop seizing point inner wall lying in substantially the same plane throughout the entire extent of said upper ledge.

5. The rotary loop taker of claim 1 in which:

(a) the shaft about which said annular frame rotates is substantially vertical; and (b) said securing means includes:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from directly above the rotary loop taker of the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

6. The rotary loop taker of claim 1 in which:

(a) the shaft about which said annular frame rotates is substantially horizontal; and (b) said securing means includes:

at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from outside the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

7. A detachable loop seizing point for use in a rotary loop taker mounted to rotate about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical mid-section of the side wall of said bobbin case carrying a radially extending rib for engaging the loop taker as the latter rotates about said bobbin case, said rotary loop taker including a frame of substantially annular construction on which the loop seizing point is installed, said frame having a cut-away portion along one segment of its circumference to provide space for the needle thread to exit from the loop seizing point of the rotary loop taker as said thread is pulled off said loop seizing point by the take-up device, said cut-away portion being defined by opposing end walls of said frame facing upon said cut-away portion, said rotary loop taker also including a frame support member extending crosswise of said substantially annular frame, with one edge portion of said crosswise extending support member facing said cut-away portion of said frame, said one edge portion of said crosswise extending support member and the one of said frame end walls that is at the trailing end of said cut-away portion during forward rotation of said frame defining a lug-receiving notch, said notch having a first wall that is generally parallel to the circumference of said frame and a second wall that is generally radially positioned with respect to said frame, said notch extending inwardly from the outer circumference of said frame, extending along said frame in an angular direction opposite to the direction of forward rotation of the frame, and extending axially of said rotary loop taker entirely through said crosswise extending support member, which loop seizing point comprises:

(a) a single continuously tapered, smoothly shaped, integrally formed forward end, said tapered forward end having its largest transverse dimensions in a base portion and tapering to its smallest transverse dimensions at its free end;

(b) a supporting lug that when installed in place on said substantially annular frame extends directly downward from immediately behind said base portion of said tapered forward end into said cut-away portion of said frame, with the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the same, said downwardly extending supporting lug extending into said lug-receiving notch defined by said one edge portion of said crosswise extending support member and said frame end wall, in nesting relationship with said notch, said tapered forward end when said loop seizing point is installed in place on said frame extending forwardly of said downwardly extending lug into said cut-away portion of said frame, said lug forming a smoothly curved junction with said tapered forward end base portion, said smoothly curved junction being free of any joints or seams;

(c) a rear portion extending rearwardly of said lug, said forward end, supporting lug and rear portion of the loop seizing point having generally the same over-all curvature as said substantially annular frame and being integrally formed from one end to the other of the loop seizing point; and (d) means for detachably securing the loop seizing point to said annular frame, said means being located entirely rearward of said tapered forward end of the loop seizing point.

8. The detachable loop seizing point of claim 7 for use in a rotary loop taker in which said lug-receiving notch extends inwardly from the outer circumference of said substantially annular frame to a location that is inward of said frame and within said frame support member edge portion that faces said cut-away portion of said frame, in which loop seizing point:

said downwardly extending supporting lug includes a foot that when the loop seizing point is installed in place on said annular frame extends from the lower portion thereof, from behind the base portion of said tapered forward end, inwardly towards the center of said annular frame to provide a smoothly curved junction between said lug, said foot, and said tapered forward end base portion, said smoothly curved junction being free of any joints or seams and extending inward beyond said base portion of said tapered forward end; and said lug foot extends inwardly into said lug-receiving notch within said one edge portion of said crosswise extending support member, in nesting relationship with said notch, with the rearwardly facing surface of said lug foot abutting at all times, throughout substantially the entire height of said foot, substantially the entire portion of said second notch wall that is formed by said crosswise extending support member.

9. The detachable loop seizing point of claim 8 in which when said loop seizing point is installed in place on said substantially annular frame said lug foot extends inward from said lug towards the center of said annular frame a distance at least equal to the diameter of the largest thread with which said sewing machine is used.

10. The detachable loop seizing point of claim 7 which has an inner wall and an outer wall, said inner wall carrying an upper ledge that defines the upper part of an initial portion of a raceway to receive said radially extending rib on the sidewall of said bobbin case and a lower ledge that defines the lower part of an initial portion of said bobbin case raceway, with a vertical wall for said initial portions of the raceway lying between said upper and lower ledges, the bottom surface of said upper ledge carried by said loop seizing point inner wall lying in substantially the same plane throughout the entire extent of said upper ledge.

11. The loop seizing point of claim 7 in which:

(a) a shaft about which said annular frame rotates is substantially vertical; and (b) said securing means includes:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from directly above the rotary loop taker of the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

12. The loop seizing point of claim 7 in which:

(a) said substantially annular frame of the rotary loop taker rotates in a substantially vertical plane; and (b) said securing means includes:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from outside the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

13. A rotary loop taker for rotation about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, which rotary loop taker comprises:

(a) a frame of substantially annular construction, said frame having a cut-away portion along one segment of its circumference to provide space for the needle thread to exit from the loop seizing point of the rotary loop taker as said thread is pulled off the loop seizing point by the take-up device, said cut-away portion being defined by opposing end walls of said frame facing upon said cut-away portion;

(b) a frame support member extending crosswise of said substantially annular frame, with one edge portion of said crosswise extending support member facing said cut-away portion of said frame;

(c) a substantially vertically oriented shaft for said annular frame attached to said frame support member and extending at generally right angles thereto for rotating said frame about said bobbin case in a predetermined plane during operation of said sewing machine;

(d) a detachable loop seizing point mounted on said frame having generally the same curvature as said substantially annular frame, said detachable loop seizing point:

(i) being integrally formed from one end to its other end, (ii) having a single continuously tapered, smoothly shaped, integrally formed forward end, said tapered forward end having its largest transverse dimensions in a base portion and tapering to its smallest transverse dimensions at its free end, (iii) having a supporting lug that extends directly downward into said cut-away portion of said frame from immediately behind said base portion of said tapered forward end, the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the frame, said tapered forward end extending forwardly of said downwardly extending supporting lug into said cut-away portion of said frame, said lug forming a smoothly curved junction with said tapered forward end base portion, said smoothly curved junction being free of any joints or seams; and (iv) having a rear portion extending rearwardly of said lug along said annular frame; and (e) means for detachably securing said loop seizing point to said frame, said securing means being located entirely rearward of said tapered forward end of said loop seizing point and including:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from directly above the rotary loop taker of the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

14. A detachable loop seizing point for use in a rotary loop taker mounted to rotate in a substantially horizontal plane about a generally cylincrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, said rotary loop taker including a frame of substantially annular construction on which the loop seizing point is installed, said frame having a cut-away portion along one segment of its circumference to provide space for the needle thread to exit from the loop seizing point of the rotary loop taker as said thread is pulled off said loop seizing point by the take-up device, said cut-away portion being defined by opposing end walls of said frame facing upon said cut-away portion, said rotary loop taker also including a frame support member extending crosswise of said substantially annular frame, with one edge portion of said crosswise extending support member facing said cut-away portion of said frame, which loop seizing point comprises:

(a) a single continuously tapered, smoothly shaped, integrally formed forward end, said tapered forward end having its largest transverse dimensions in a base portion and tapering to its smallest transverse dimensions at its free end;

(b) a supporting lug that when installed in place on said substantially annular frame extends directly downward from immediately behind said base portion of said tapered forward end into said cut-away portion of said frame, with the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the same, said tapered forward end when said loop seizing point is installed in place on said frame extending forwardly of said downwardly extending lug into said cut-away portion of said frame, said lug forming a smoothly curved junction with said tapered forward end base portion, said smoothly curved junction being free of any joints or seams;

(c) a rear portion extending rearwardly of said lug, said forward end, supporting lug and rear portion of the loop seizing point having generally the same over-all curvature as said substantially annular frame and being integrally formed from one end to the other of the loop seizing point; and (d) means for detachably securing the loop seizing point to said annular frame, said means being located entirely rearward of said tapered forward end of the loop seizing point and including:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from directly above the rotary loop taker of the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

15. A rotary loop taker for rotation about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, which rotary loop taker comprises:

(a) a frame of substantially annular construction, said frame having a cut-away portion along one segment of its circumference to provide space for the needle thread to exit from the loop seizing point of the rotary loop taker as said thread is pulled off the loop seizing point by the take-up device, said cut-away portion being defined by opposing end walls of said frame facing upon said cut-away portion;

(b) a frame support member extending crosswise of said substantially annular frame, with one edge portion of said crosswise extending support member facing said cut-away portion of said frame;

(c) a substantially horizontally oriented shaft for said annular frame attached to said frame support member and extending at generally right angles thereto for rotating said frame about said bobbin case in a predetermined plane during operation of said sewing machine;

(d) a detachable loop seizing point mounted on said frame having generally the same curvature as said substantially annular frame, said detachable loop seizing point:

(i) being integrally formed from one end to its other end, (ii) having a single continuously tapered, smoothly shaped, integrally formed forward end, said tapered forward end having its largest transverse dimensions in a base portion and tapering to its smallest transverse dimensions at its free end, (iii) having a supporting lug that extends directly downward into said cut-away portion of said frame from immediately behind said base portion of said tapered forward end, the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the frame, said tapered forward end extending forwardly of said downwardly extending supporting lug into said cut-away portion of said frame, said lug forming a smoothly curved junction with said tapered forward end base portion, said smoothly curved junction being free of any joints or seams; and (iv) having a rear portion extending rearwardly of said lug along said annular frame; and (e) means for detachably securing said loop seizing point to said frame, said securing means being located entirely rearward of said tapered forward end of said loop seizing point and including:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from outside the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

16. A detachable loop seizing point for use in a rotary loop taker mounted to rotate, in a substantially vertical plane, about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, said rotary loop taker including a frame of substantially annular construction on which the loop seizing point is installed, said frame having a cut-away portion along one segment of its circumference to provide space for the needle thread to exit from the loop seizing point of the rotary loop taker as said thread is pulled off said loop seizing point by the take-up device, said cut-away portion being defined by opposing end walls of said frame facing upon said cut-away portion, said rotary loop taker also including a frame support member extending crosswise of said substantially annular frame, with one edge portion of said crosswise extending support member facing said cut-away portion of said frame, which loop seizing point comprises:

(a) a single continuously tapered, smoothly shaped, integrally formed forward end, said tapered forward end having its largest transverse dimensions in a base portion and tapering to its smallest transverse dimensions at its free end;

(b) a supporting lug that when installed in place on said substantially annular frame extends directly downward from immediately behind said base portion of said tapered forward end into said cut-away portion of said frame, with the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the same, said tapered forward end when said loop seizing point is installed in place on said frame extending forwardly of said downwardly extending lug into said cut-away portion of said frame, said lug forming a smoothly curved junction with said tapered forward end base portion, said smoothly curved junction being free of any joints or seams;

(c) a rear portion extending rearwardly of said lug, said forward end, supporting lug and rear portion of the loop seizing point having generally the same over-all curvature as said substantially annular frame and being integrally formed from one end to the other of the loop seizing point; and (d) means for detachably securing said loop seizing point to said frame, said securing means being located entirely rearward of said tapered forward end of said loop seizing point and including:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from outside the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

17. A rotary loop taker for rotation in a substantially horizontal plane about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, which comprises:

(a) a frame of substantially annular construction, said frame having a cut-away portion along one segment of its circumference to provide space for the needle thread to exit from the loop seizing point of the rotary loop taker as said thread is pulled off the loop seizing point by the take-up device, said cut-away portion being defined by opposing end walls of said frame facing upon said cut-away portion;

(b) means for rotatably supporting said frame in said lock-stitch sewing machine;

(c) a detachable loop seizing point mounted on said frame having generally the same curvature as said substantially annular frame, said detachable loop seizing point:

(i) being integrally formed from one end to its other end, (ii) having a single continuously tapered, smoothly shaped, integrally formed forward end, said tapered forward end having its largest transverse dimensions in a base portion and tapering to its smallest transverse dimensions at its free end, (iii) having a supporting lug that extends directly downward into said cut-away portion of said frame from immediately behind said base portion of said tapered foward end, the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the frame, said tapered forward end extending forwardly of said downwardly extending lug into said cut-away portion of said frame, said downwardly extending supporting lug including a foot that extends from the lower portion thereof, from behind the base portion of said tapered forward end, inwardly towards the center of said annular frame to provide a smoothly curved junction between said lug, said foot, and said tapered forward end base portion, said smoothly curved junction being free of any joints or seams and extending inward beyond said base portion of said tapered forward end, and (iv) having a rear portion extending rearwardly of said lug along said annular frame; and (d) means for detachably securing said loop seizing point to said frame, said means being located entirely rearward of said tapered forward end of said loop seizing point and including:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from directly above the rotary loop taker of the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

18. A rotary loop taker for rotation, in a substantially vertical plane, about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, which comprises:

(a) a frame of substantially annular construction, said frame having a cut-away portion along one segment of its circumference to provide space for the needle thread to exit from the loop seizing point of the rotary loop taker as said thread is pulled off the loop seizing point by the take-up device, said cut-away portion being defined by opposing end walls of said frame facing upon said cut-away portion;

(b) means for rotatably supporting said frame in said lock-stitch sewing machine;

(c) a detachable loop seizing point mounted on said frame having generally the same curvature as said substantially annular frame, said detachable loop seizing point:

(i) being integrally formed from one end to its other end, (ii) having a single continuously tapered, smoothly shaped, integrally formed forward end, said tapered forward end having its largest transverse dimensions in a base portion and tapering to its smallest transverse dimensions at its free end, (iii) having a supporting lug that extends directly downward into said cut-away portion of said frame from immediately behind said base portion of said tapered forward end, the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the frame, said tapered forward end extending forwardly of said downwardly extending lug into said cut-away portion of said frame, said downwardly extending supporting lug including a foot that extends from the lower portion thereof, from behind the base portion of said tapered forward end, inwardly towards the center of said annular frame to provide a smoothly curved junction between said lug, said foot, and said tapered forward end base portion, said smoothly curved junction being free of any joints or seams and extending inward beyond said base portion of said tapered forward end, and (iv) having a rear portion extending rearwardly of said lug along said annular frame; and (d) means for detachably securing said loop seizing point to said frame, said means being located entirely rearward of said tapered forward end of said loop seizing point and including:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from outside the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

19. A rotary loop taker for rotation, in a substantially horizontal plane, about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, which comprises:

(a) a frame of substantially annular construction, said frame having a cut-away portion along one segment of its circumference to provide space for the needle thread to exit from the loop seizing point of the rotary loop taker as said thread is pulled off the loop seizing point by the take-up device, said cut-away portion being defined by opposing end walls of said frame facing upon said cut-away portion;

(b) means for rotatably supporting said frame in said lock-stitch sewing machine;

(c) a detachable loop seizing point mounted on said frame having generally the same curvature as said substantially annular frame, said detachable loop seizing point:

(i) being integrally formed from one end to its other end, (ii) having a single continuously tapered, smoothly shaped, integrally formed forward end, said tapered forward end having its largest transverse dimensions in a base portion and tapering to its smallest transverse dimensions at its free end, (iii) having a supporting lug that extends directly downward into said cut-away portion of said frame from immediately behind said base portion of said tapered forward end, the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the frame, said tapered forward end extending forwardly of said downwardly extending lug into said cut-away portion of said frame, and (iv) having a rear portion extending rearwardly of said lug along said annular frame;

(d) a gib detachably secured to said frame to define the upper part of the middle and final portions of a raceway for said bobbin case to receive said radially extending rib on the side wall of said case, said loop seizing point having an inner wall and an outer wall, said inner wall carrying an upper ledge defining the upper part of the initial portion of said bobbin case raceway and a lower ledge that defines the lower part of the initial portion of said bobbin case raceway, the bottom surface of said upper ledge lying in substantially the same horizontal plane throughout the entire extent of said ledge; and (e) means for detachably securing said loop seizing point to said frame, said means being located entirely rearward of said tapered forward end of said loop seizing point and including:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from directly above the rotary loop taker of the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

20. A rotary loop taker for rotation, in a substantially vertical plane, about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, which comprises:

(a) a frame of substantially annular construction, said frame having a cut-away portion along one segment of its circumference to provide space for the needle thread to exit from the loop seizing point of the rotary loop taker as said thead is pulled off the loop seizing point by the take-up device, said cut-away portion being defined by opposing end walls of said frame facing upon said cut-away portion;

(b) means for rotatably supporting said frame in said lock-stitch sewing machine;

(c) a detachable loop seizing point mounted on said frame having generally the same curvature as said substantially annular frame, said detachable loop seizing point:

(i) being integrally formed from one end to its other end, (ii) having a single continuously tapered, smoothly shaped, integrally formed forward end, said tapered forward end having its largest transverse dimensions in a base portion and tapering to its smallest transverse dimensions at its free end, (iii) having a supporting lug that extends directly downward into said cut-away portion of said frame from immediately behind said base portion of said tapered foward end, the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the frame, said tapered forward end extending forwardly of said downwardly extending lug into said cut-away portion of said frame, and (iv) having a rear portion extending rearwardly of said lug along said annular frame; and (d) a gib detachably secured to said frame to define the upper part of the middle and final portions of a raceway for said bobbin case to receive said radially extending rib on the side wall of said case, said loop seizing point having an inner wall and an outer wall, said inner wall carrying an upper ledge defining the upper part of the initial portion of said bobbin case raceway and a lower ledge that defines the lower part of the initial portion of said bobbin case raceway, the bottom surface of said upper ledge lying in substantially the same horizontal plane throughout the entire extent of said ledge; and (e) means for detachably securing said loop seizing point to said frame, said means being located entirely rearward of said tapered forward end of said loop seizing point and including:

(i) at least one positioning and retaining means comprising a protuberance on one of said rearwardly facing surface on said downwardly extending supporting lug and the surface of said annular frame end wall it abuts at said trailing end of said cut-away portion of the frame as the same rotates in the forward direction;

(ii) means defining at least one complementary cavity on the other of said surfaces for receiving said protuberance; and (iii) releasable anchoring means at the rear portion of said detachable loop seizing point for securing said rear portion to said annular frame when said protuberance and cavity are mated together, said protuberance, cavity and anchoring means preventing any radial, axial or circumferential movement of the loop seizing point relative to said annular frame when it is installed on said frame, said releasable anchoring means being located radially outward of said bobbin case in an exposed position accessible to an operator from outside the sewing machine without removing any other part of the rotary loop taker or any other part of said machine, said releasable anchoring means when released permitting circumferential movement of said loop seizing point with respect to the frame to (i) clear said protuberance from said cavity, and (ii) through said clearance, permit an immediate inward tilting of the top of the loop seizing point and an outward tilting of the bottom of the loop seizing point to clear the loop seizing point both of the bobbin case and of the surrounding parts of the sewing machine for removal of the loop seizing point from its frame, whereby the loop seizing point is quickly and readily removable, when desired, from its annular frame.

* * * * *